US008992399B2

(12) United States Patent
Wehrell

(10) Patent No.: US 8,992,399 B2
(45) Date of Patent: Mar. 31, 2015

(54) PHYSICAL TRAINING APPARATUS AND METHOD

(75) Inventor: Michael A. Wehrell, Tampa, FL (US)

(73) Assignee: Michael A. Wehrell, Tampa, FL (US)

( * ) Notice: Subject to any disclaimer, the term of this patent is extended or adjusted under 35 U.S.C. 154(b) by 0 days.

(21) Appl. No.: 12/694,102

(22) Filed: Jan. 26, 2010

(65) Prior Publication Data

US 2010/0130338 A1 May 27, 2010

Related U.S. Application Data

(62) Division of application No. 11/364,181, filed on Mar. 1, 2006, now Pat. No. 7,651,450.

(60) Provisional application No. 60/752,872, filed on Dec. 23, 2005, provisional application No. 60/656,920, filed on Mar. 1, 2005, provisional application No. 60/656,887, filed on Mar. 1, 2005.

(51) Int. Cl.
*A63B 21/02* (2006.01)
*A61H 1/02* (2006.01)
(Continued)

(52) U.S. Cl.
CPC ..... *A61H 1/0229* (2013.01); *A63B 21/0552* (2013.01); *A63B 21/1415* (2013.01); *A63B 21/1419* (2013.01); *A63B 21/1423* (2013.01); *A63B 21/1438* (2013.01); *A63B 21/154* (2013.01); *A63B 21/00069* (2013.01);
(Continued)

(58) Field of Classification Search
USPC ..... 482/123–124, 69, 92, 23–24, 33, 43, 482/82; 434/252; 473/207, 215–216; 472/131
See application file for complete search history.

(56) References Cited

U.S. PATENT DOCUMENTS 775,989 A 11/1904 Roberts
3,937,461 A * 2/1976 Lew ..... 482/43
(Continued)

FOREIGN PATENT DOCUMENTS

| | | |
|---|---|---|
| EP | 0936044 | 8/1999 |
| WO | 01/19462 A1 | 3/2001 |
| WO | 2005/009544 A2 | 2/2005 |

OTHER PUBLICATIONS

International Searching Authority, International Search Report PCT/US2012/022230 mailed May 7, 2012, 1 page.

*Primary Examiner* — Oren Ginsberg
*Assistant Examiner* — Andrew S Lo
(74) *Attorney, Agent, or Firm* — Duane Morris LLP

(57) ABSTRACT

A resistance training apparatus and method for providing multiple training vectors having points of origin variable by direction and elevation to a trainee. The apparatus may accommodate multiple trainees and provide multiple training vectors to each trainee. The apparatus provides the training vectors by attaching tethers such as elastic cords to harnesses worn around body portions of an athlete in a configuration that allows the athlete to perform a sports-specific or therapeutic movement at an optimum speed. The apparatus may include a base forming the training area and a pair of tower assemblies, each providing elastic cords for attachment to the harnesses worn by the athlete. In another embodiment training vectors are provided to patients or trainees who cannot fully support their own body weight. The elastic cords are independently adjustable such that balanced or unbalanced loading may be applied simultaneously to a trainee from multiple directions and planes.

3 Claims, 35 Drawing Sheets

(51) Int. Cl.
*A63B 21/055* (2006.01)
*A63B 21/00* (2006.01)
*A63B 21/04* (2006.01)

(52) U.S. Cl.
CPC ..... *A63B21/04* (2013.01); *A63B 21/0442* (2013.01); *A63B 21/0557* (2013.01); *A63B 21/1434* (2013.01); *A63B 2208/0204* (2013.01)
USPC ..... 482/124; 482/121

(56) References Cited

U.S. PATENT DOCUMENTS 4,125,257 A * 11/1978 Lew ..... 482/43
4,431,184 A * 2/1984 Lew et al. ..... 482/43
4,551,108 A 11/1985 Bass
4,659,084 A 4/1987 Vuick
4,863,163 A 9/1989 Wehrell
4,968,028 A * 11/1990 Wehrell ..... 482/124
5,048,836 A 9/1991 Bellagamba
5,050,871 A 9/1991 Douglas et al.
5,407,411 A * 4/1995 Trainor ..... 482/95
5,421,783 A * 6/1995 Kockelman et al. ..... 472/135
5,586,962 A * 12/1996 Hallmark ..... 482/129
5,597,376 A 1/1997 Bode et al.
5,613,926 A * 3/1997 Michaelson ..... 482/121
5,632,686 A * 5/1997 Checketts ..... 472/131
5,788,606 A * 8/1998 Rich ..... 482/27
5,803,822 A 9/1998 Pursell
5,820,533 A * 10/1998 Goldman ..... 482/124
5,885,190 A * 3/1999 Reiter ..... 482/69
5,941,807 A * 8/1999 Cassidy et al. ..... 482/146
6,120,418 A * 9/2000 Plough ..... 482/69
6,149,559 A * 11/2000 Mackey ..... 482/124
6,302,828 B1 * 10/2001 Martin et al. ..... 482/69
6,554,747 B1 * 4/2003 Rempe ..... 482/38
6,612,845 B1 * 9/2003 Macri et al. ..... 434/247
6,966,870 B2 * 11/2005 Lan ..... 482/55
7,182,695 B1 * 2/2007 Tostenson et al. ..... 472/50
7,874,970 B2 * 1/2011 Glisan ..... 482/124
2003/0083137 A1 * 5/2003 Checketts ..... 472/131
2003/0096681 A1 * 5/2003 Myers et al. ..... 482/94
2005/0014571 A1 * 1/2005 Varner ..... 473/257
2005/0026757 A1 * 2/2005 Creary ..... 482/143
2005/0032613 A1 * 2/2005 Wehrell ..... 482/133
2005/0043156 A1 * 2/2005 Wehrell ..... 482/134
2006/0199706 A1 9/2006 Wehrell
2010/0298106 A1 * 11/2010 Bowser ..... 482/148

* cited by examiner

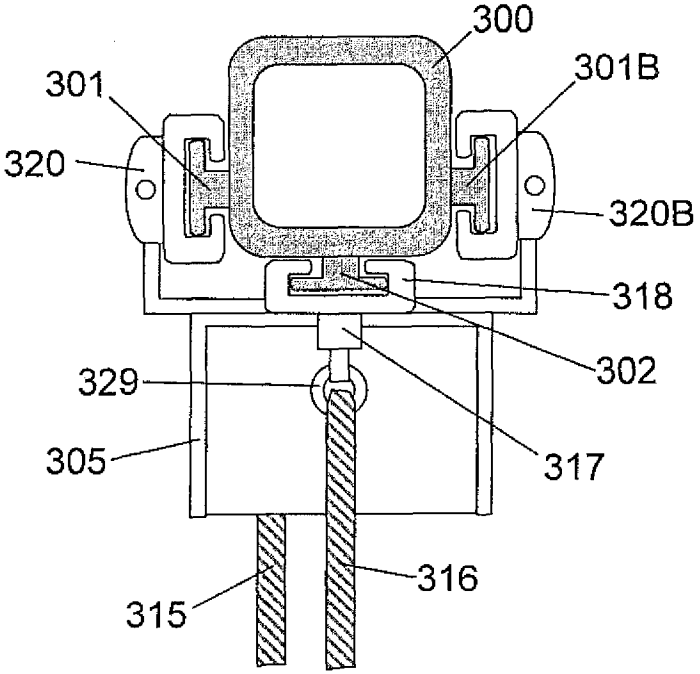
FIGURE 38 (View A)
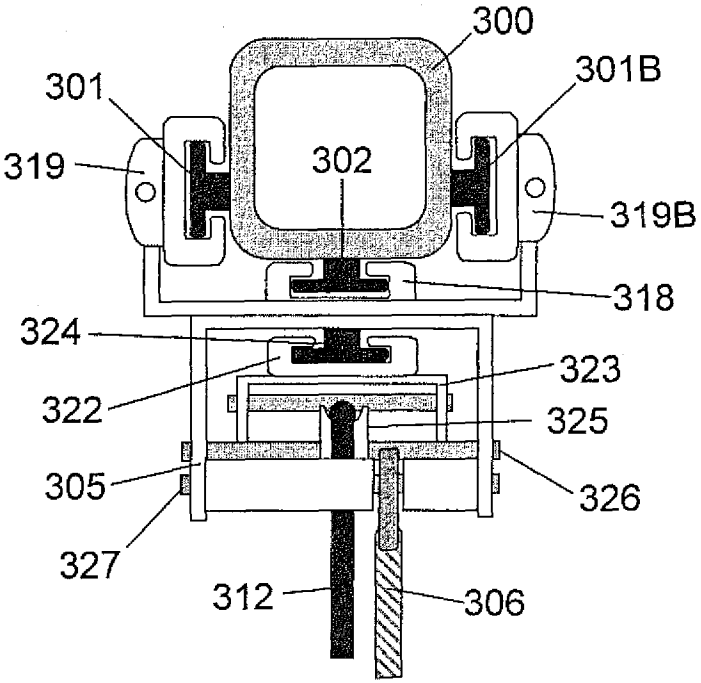
FIGURE 37 (View B)

PHYSICAL TRAINING APPARATUS AND METHOD

CLAIM OF PRIORITY

This application is a divisional application of application Ser. No. 11/364,181 filed Mar. 1, 2006, now U.S. Pat. No. 7,651,450, the entirety of which is incorporated herein by reference, which claims the priority of U.S. Provisional Patent Application No. 60/752,872 filed Dec. 23, 2005, by the inventor hereof, the entirety of which is incorporated by reference herein; U.S. Provisional Patent Application No. 60/656,920 filed Mar. 1, 2005, by the inventor hereof, the entirety of which is incorporated by reference herein; and U.S. Provisional Patent Application No. 60/656,887 filed Mar. 1, 2005, by the inventor hereof, the entirety of which is incorporated by reference herein.

RELATED APPLICATIONS

This application is related to co-pending U.S. patent application Ser. No. 10/892,568 entitled "Physical Training Apparatus And Method" filed Jul. 16, 2004, by the inventor hereof, the contents of which is incorporated by reference herein; and U.S. patent application Ser. No. 10/892,196 entitled "Swing Training Apparatus And Method" filed Jul. 16, 2004, by the inventor hereof, the contents of which is incorporated by reference herein.

BACKGROUND OF THE INVENTION

The present invention relates to a physical training apparatus and method for training persons such as athletes or physical therapy patients to improve various motor skills. The present invention further relates to a physical training apparatus and method for training specialized athletes such as golfers and baseball players who rely on generating power by rotation of the hips and torso. More particularly, it relates to a physical training apparatus and method for providing forces of either constant or varying magnitude opposing the motion of a single or multiple points on the body of a trainee while performing slow or high speed movements.

Physical training and conditioning have long been recognized as desirable for improving various motor skills to thereby improve the performance of an athlete, the rehabilitation of a physical therapy patient, or the overall physical well-being of the trainee. Training with resistance while performing specific movements with the body has been found to be very effective in improving various physical abilities such as functional strength, running speed, first-step quickness, jumping ability, and kicking ability. Such resistance training is increasingly becoming favored over training with heavy weights using slow non-sports specific motions.

For example, if an athlete wants to run faster it has been found to be more beneficial to apply light resistance to the leg muscles while running than by performing a press with the legs with heavy weights. Both of these training methods will strengthen the leg muscles of the athlete, however, the high-speed training by providing light resistance while running allows the athlete to generate more power at high speeds since the muscle is conditioned with resistance at high speeds. Training the muscles using slow movement with resistance promotes power generation at slow speeds since the muscle is conditioned at slow speeds. Both training methods are important to most athletes. However, for athletic performance optimization at high speeds the muscles must be physically and neurologically trained at high speeds. The term "training vector" as used herein shall mean a force opposing the motion of a portion of a trainee through a predetermined range of motion. The magnitude and direction of a training vector may be relatively constant or may vary through the predetermined range of motion.

U.S. Pat. Nos. 4,968,028 and 4,863,163 entitled "Vertical Jump Exercise Apparatus" issued to the inventor of the present disclosure each disclose resistance training apparatus for vertical jump training and conditioning. The prior art system disclosed in the Wehrell patents applies two training vectors having relatively constant magnitude to the hips of the trainee for applying resistance to the legs while performing a jumping motion.

A later modification of the exercise apparatus disclosed in the Wehrell patents provided relatively constant resistance to the back of the knees of a trainee performing a running motion by attaching the elastic members of the exercise apparatus to detachable leg harnesses worn by the trainee. This embodiment provided resistance for training the hip flexors of the trainee at high speeds.

Similarly, if an athlete wants to generate more power by rotation of the hips and torso, it will be beneficial to apply light resistance to the rotation of the hips and torso as the athlete performs a specific athletic movement such as swinging a golf club or a baseball/softball bat. Such rotational training of the hips and torso may be beneficial to other athletes such as soccer players, place kickers, track and field athletes, tennis players, and athletes of other racket sports.

Many sports related movements involve multiple muscle groups moving multiple body parts simultaneously to perform the specific movement. For example, when an athlete jumps he or she uses the legs, back and arms simultaneously. To optimize training for a particular movement it is beneficial to train using a natural jumping motion while applying resistance to the legs, back, arms and other body portions simultaneously. Such an exercise method would be more effective than methods where resistance is only applied to the legs because it allows major muscle groups used in jumping to be fired in the proper neurological sequence with applied resistance.

While it is possible in the prior art exercise apparatus described in the Wehrell patents to apply training vectors to a trainee performing a running motion, there remains a need for a physical training apparatus that applies training vectors to the hands, legs, back and other points on the trainee's body for providing resistance to multiple muscle groups while performing complex sports specific movements.

Accordingly, it is an object of the present invention to obviate many of the deficiencies in the prior art and to provide a novel physical training apparatus and method.

It is an object of the present invention to provide a novel physical training apparatus comprising means for providing at least eight training vectors to a trainee.

It is also an object of the present invention to provide a novel physical training apparatus comprising a plurality of means for providing training vectors to a trainee wherein the origin of one or more training vectors is variable in a first and a second dimension and the origin of one or more of the other training vectors is variable in either said first or second dimension and a third dimension normal to said first and second dimensions.

It is another object of the present invention to provide a novel physical training apparatus comprising a plurality of means for providing training vectors to a trainee wherein the training vectors originate from at least three elevations.

It is a further object of the present invention to provide a novel physical training apparatus comprising one or more means for providing a training vector to a trainee and a means to support at least a portion of the trainee's body weight.

It is yet another object of the present invention to provide physical training apparatus comprising a base forming a training area, one or more harnesses each adapted to be worn by a trainee training in said training area, at least one elastic member attached to each harness for providing a force opposing the motion of the harness in a predetermined range of motion, said elastic members having a length whereby the force is relatively constant over said predetermined range. The apparatus further comprises an elongated tracking mechanism attached to said base for directing each of said elastic members out of said training area, at least one tracking mechanism being substantially horizontal and at least one tracking mechanism being substantially vertical.

It is another object of the present invention to provide a novel physical training apparatus comprising a base forming a training surface, a plurality of means for providing training vectors to a trainee training on said training surface, said means being attached to said base and comprising an elastic member and tracking members for directing said elastic member from a vector origin location near the training surface to an anchor location. The apparatus further comprises a plurality of means for providing training vectors to a trainee training on said training surface, said means being attached to said base and comprising an elastic member and tracking members for directing said elastic member from a vector origin location elevated from the training surface to an anchor location.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIGS. 37 and 38 are side views of the trolley assembly of FIG. 34.

DESCRIPTION OF PREFERRED EMBODIMENTS

With reference to the figures where like elements have been given like numerical designations to facilitate an understanding of the present invention, the various embodiments of the physical training apparatus of the present invention are described.

According to one aspect of the present invention, a physical training apparatus and method are disclosed for providing multiple training vectors to a trainee while performing various athletic or therapeutic movements such as jumping, running or walking. According to a further aspect of the present invention, a physical training apparatus and method are disclosed for providing training vectors having points of origin variable by direction and elevation to a trainee while performing various athletic or therapeutic movements such as jumping, running or walking or more complex athletic or therapeutic movements. According to another aspect of the present invention, a physical training apparatus and method are disclosed for providing training vectors having points of origin variable by direction and elevation to a plurality of trainees while each are performing athletic or therapeutic movements. According to yet another aspect of the present invention, a physical training apparatus and method are disclosed for providing training vectors and therapeutic exercises to patients or trainees who cannot fully support their own body weight. The physical training apparatus may provide up to sixteen or more training vectors so that multiple muscle groups of a trainee may be exercised simultaneously.

Figure 1:
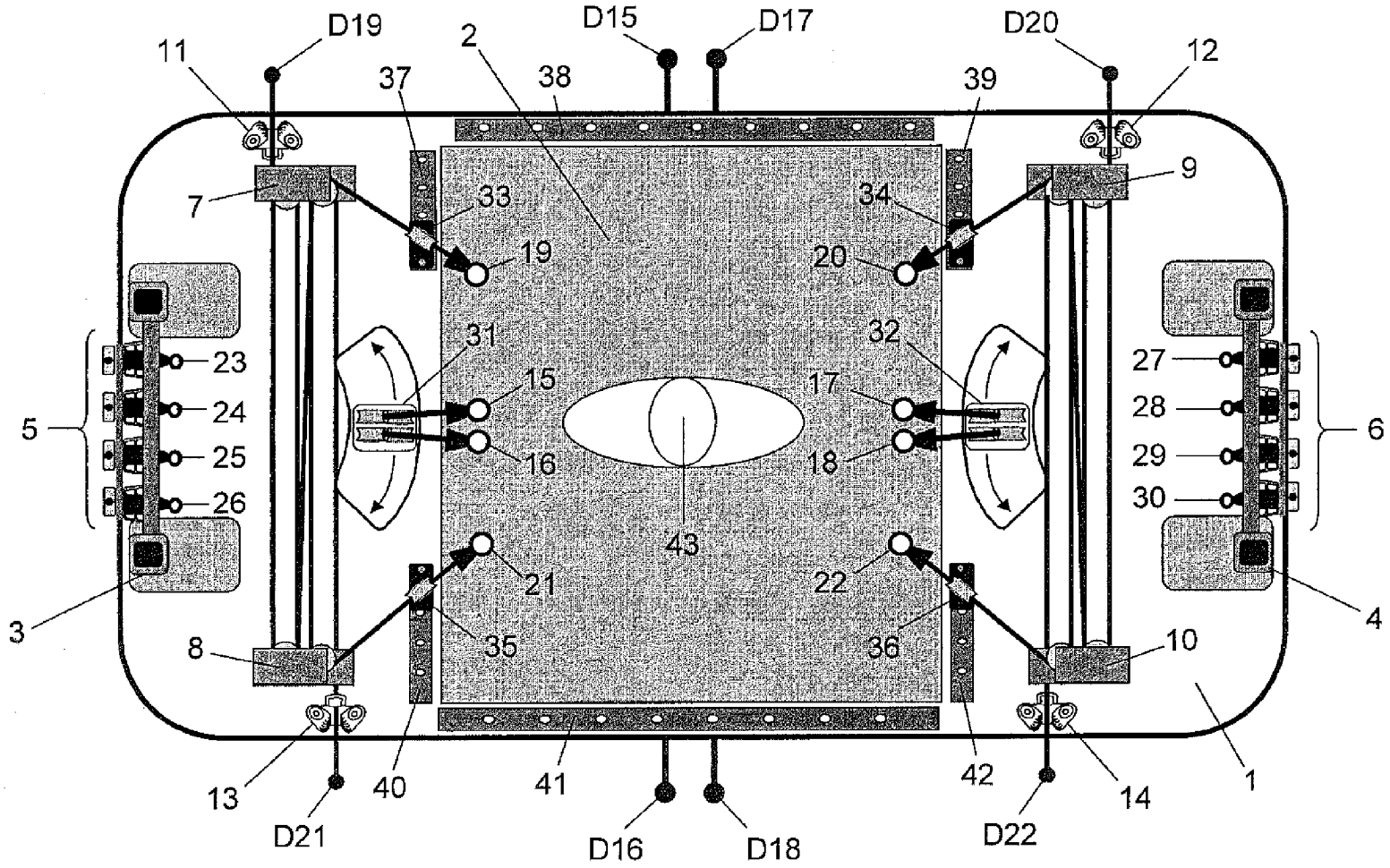
FIG. 1 is a top plan view of an embodiment of the present disclosure for providing a plurality of training vectors having points of origin variable by direction and elevation to a trainee.

FIG. 1 illustrates one embodiment of the physical training apparatus according to the present invention for providing a plurality of training vectors having points of origin variable by direction and elevation to a trainee. With reference to FIG. 1, the physical training apparatus comprises a platform or base 1 forming a training surface on which an athlete or trainee 43 may train. The base 1 may be provided with a centrally located matted exercise area 2 to provide the trainee 43 with cushioning during training exercises. At least two tower assemblies 3, 4 may be mounted along the periphery of the base 1. Both the base 1 and the tower assemblies 3, 4 provide a means for applying training vectors to multiple body portions of the trainee 43.

With reference to FIG. 1, at least four pulley housing structures 7-10 are mounted on the base 1. The pulley housing structures 7-10 route elastic members 19-22 to movable pulley assemblies 33-36. The elastic members 19-22 have a length whereby the magnitude of the training vector provided by each elastic member 19-22 is relatively constant through the range of motion of the body portion of the trainee performing an exercise or training motion. The elastic members 19-22 are routed from a cam assembly 11-14 or other suitable anchor means, between a series of tracking mechanisms, such as pulleys, provided in the housing structures 7-10, to the movable pulley assemblies 33-36. Connectors (not shown) may be attached to the elastic members 19-22 whereby the connectors may be connected to harnesses (not shown) worn on body portions of the trainee. The cam assemblies 11-14 provide a cleating means to adjust the effective lengths of elastic members 19-22 for the purpose of altering the resistance provided by the elastic members 19-22. This may be accomplished by extracting or retracting the distal ends D19-D22 of the elastic members 19-22 through the cam assemblies 11-14. The pulley housing structures 7-10 thus provide a path for routing the elastic members 19-22 therebetween so that an elastic member many times the distance between housing structures mounted on the same side of the exercise area 2 may be utilized. It is also envisioned that a plurality of the training modules disclosed in co-pending U.S. patent application Ser. No. 10/892,568, the contents of which are incorporated by reference herein, may be used in place of the pulley housing structures 7-10.

The movable pulley assemblies 33-36 provide the points of origin for the training vectors provided by the elastic members 19-22. The pulley assemblies 33-36 may rotate 360 degrees and tilt +/−90 degrees in any direction so that the elastic members 19-22 track smoothly on the pulley assemblies 33-36 through the entire range of motion of the body portion of the trainee. The pulley assemblies 33-36 may be mounted on rails 37-42 affixed to the base 1 thereby allowing the pulley assemblies 33-36 to slide linearly to accommodate different exercises performed by a trainee, to accommodate trainees having different body dimensions, or to alter and or adjust the direction of the training vector origin supplied by the pulley assemblies 33-36. The rails 37-42 are slotted so that the pulley assemblies 33-36 may be positioned along the length of the rails 37-42. The pulley assemblies 33-36 may also be adaptable to lock in place on the rails 37-42 by any suitable locking means such as spring loaded locking mechanisms.

At least four elastic members 15-18 are routed from a cam assembly (not shown) or other suitable anchor means beneath the base 1 through pulleys provided in tracking assemblies 31, 32 which provide the point of origin for the training vectors provided by the elastic members 15-18. The elastic members 15-18 have a length whereby the magnitude of the training vector provided by each elastic member 15-18 is relatively constant through the range of motion of the body portion of the trainee performing an exercise or training motion. The cam assemblies (not shown) provide a cleating means to adjust the lengths of the elastic members 15-18 for the purposes of altering the resistance of the elastic members 15-18. This may be accomplished by extracting or retracting the distal ends D15-D18 of the elastic members 15-18 through the cam assemblies (not shown). The tracking assemblies 31, 32 may rotate about an axis perpendicular to the base 1 and outwardly lateral to the respective tracking assembly 31, 32 thereby allowing the elastic members 15-18 to track smoothly on the tracking assemblies 31, 32 through the entire range of motion of the body portion of the trainee. Thus, the training vectors provided by the elastic members 15-18 can rotate approximately 120 degrees about the respective tracking assembly pivot point or axis. Connectors (not shown) may be attached to the elastic members 15-18 whereby the connectors may be connected to harnesses (not shown) worn on body portions of the trainee.

With reference to FIG. 1, the tower assemblies 3, 4 house power module assemblies 5, 6 that route elastic members 23-26 and 27-30, respectively. The elastic members 23-30 have a length whereby the magnitude of the training vector provided by each elastic member 23-30 is relatively constant through the range of motion of the body portion of the trainee performing an exercise or training motion. The elastic members 23-30 are routed from a cam assembly (not shown) or other suitable anchor means, between a series of tracking mechanisms such as pulleys provided in the power module assemblies 5, 6 to hanging pulley assemblies (not shown) which provide the point of origin for the training vectors provided by the elastic members 23-30. The hanging pulley assemblies are rotatable and tillable such that the elastic members 23-30 track smoothly on the pulley assemblies through the entire range of motion of the body portion of the trainee. Connectors (not shown) may be attached to the elastic members 23-30 whereby the connectors may be connected to harnesses (not shown) worn on body portions of the trainee. The cam assemblies (not shown) provide a cleating means to adjust lengths of elastic members 23-30 for the purposes of altering the resistance of the elastic members 23-30. The power module assemblies 5, 6 may lock at multiple positions in the respective tower assembly 3, 4 for the purposes of altering the plane of origin of the training vectors provided by the elastic members 23-30 relative to the base 1. Thus, every elastic member 15-30 may be directed to any point on the exercise area 2 to support resistance training for athletic or therapeutic exercises.

The elastic members 15-30 have distal ends that may be extracted through the respective cam assemblies so that the magnitude of the training vectors provided thereby may be selectively increased by shortening the effective length of the elastic members 15-30. Alternatively, the magnitude of the training vectors may be decreased by increasing the effective length of the elastic members 15-30 by releasing the cam assemblies and allowing the members to retract. The cam assemblies may comprise any means suitable for securing the elastic members such as cleats, cam cleats or other suitable anchor means known in the industry. The "effective length" of the elastic members is the length of the elastic member between the anchor or cam assembly and the end of the member attached to a harness connector.

The range of variance of the magnitude of a training vector is limited by the diameter of the elastic member. For example, the elastic member 19 may have a diameter of ⅜ inches. The effective length of the elastic member 19 may be varied to thereby vary the force provided by the elastic member in the range between about twenty and about forty pounds. A smaller diameter elastic member (e.g., a diameter of about 5/16 inches), however, would provide a useful resistance force range from about four to about twenty pounds. Accordingly, a larger diameter elastic member (e.g., a diameter of about ½ inches) would provide a useful resistance force range from about thirty-Eve to about sixty pounds. Furthermore, by utilizing the training modules disclosed in co-pending U.S. patent application Ser. No. 10/892,568, the contents of which are incorporated by reference herein, and where practical in the present invention, the effective range of forces may be expanded without having to replace elastic members.

Figure 2:
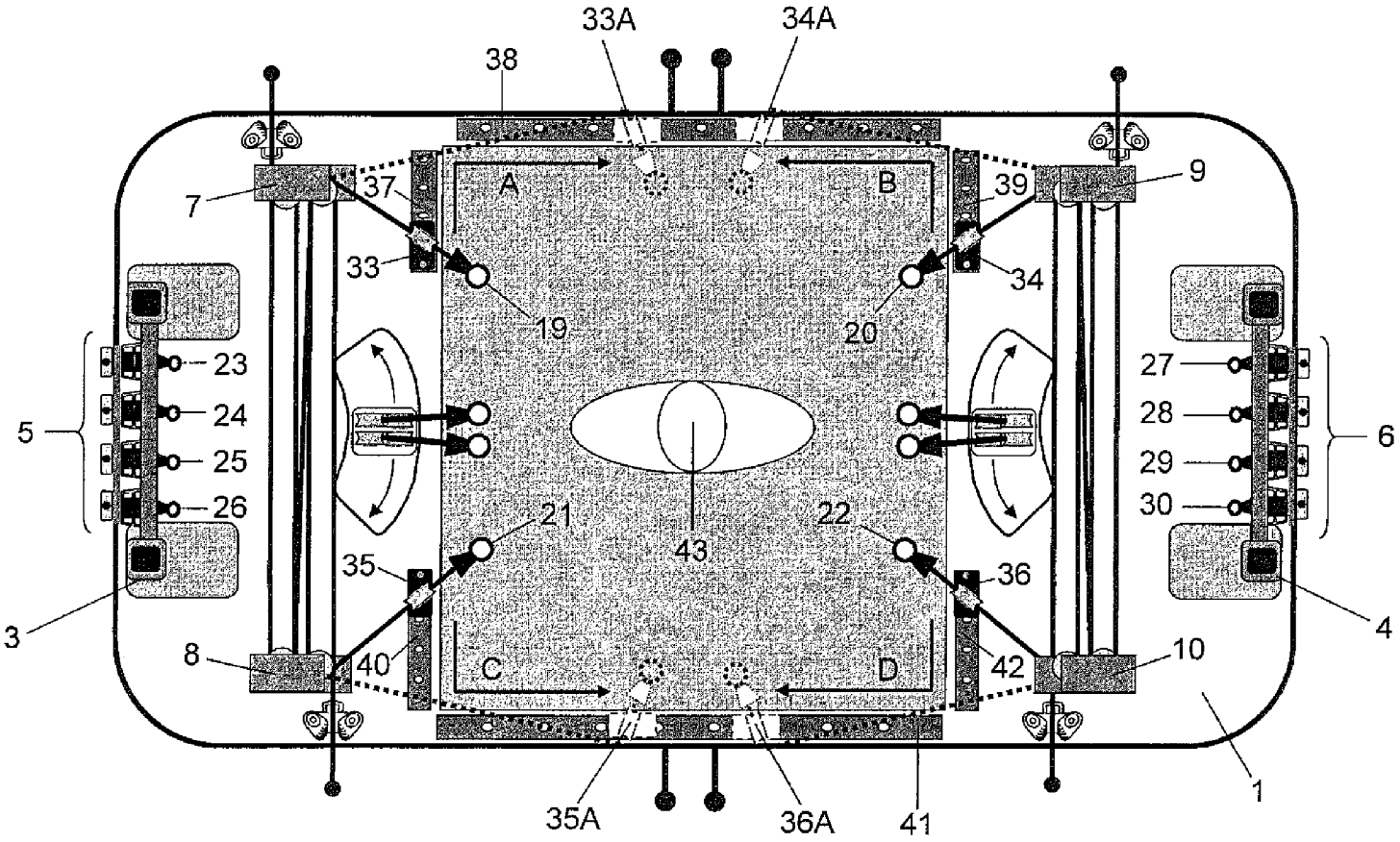
FIG. 2 is a top plan view of another embodiment of the present disclosure for providing a plurality of training vectors having points of origin variable by direction and elevation to a trainee.

FIG. 2 illustrates another embodiment of the physical training apparatus according to the present invention for providing a plurality of training vectors having points of origin variable by direction and elevation to a trainee. With reference to FIG. 2, the pulley assemblies 33-36 may be fixed on the upper surface of the base 1 allowing their position to be set anywhere along the rails 37-42 as illustrated by arrows A, B, C and D. Thus, the point of origin of the training vectors may be moved along the rails 37-42. For example, the pulley assembly 33 can be moved and locked into many positions along the rails 37, 38. As illustrated in FIG. 2, the pulley assembly 33 may be moved to a new position 33A on the rail 38. Thus, the elastic member 19 is routed from a cam assembly or other suitable anchor means, between a series of tracking mechanisms provided in the housing structures 7, 8 to the new position 33A on the rail 38 to thereby change the point of origin of the training vector provided by the elastic member 19. The difference between the locations of the pulley assembly 33 along the rails 37, 38 indicates a typical adjustment range for the pulley assembly 33. Note that the pulley assembly 33 can be attached to multiple positions along any rail 37-42. Likewise, the pulley assemblies 34-36 may be moved and locked into multiple positions along any of the rails 37-42 to thereby change the point of origin of the training vectors provided by the elastic members 20-22. The difference between the alternative locations 34A-36A of the pulley assemblies 34-36 indicate typical adjustment ranges for the pulley assemblies 34-36. Thus, the training vectors provided by the elastic members 19-22 may have a point of origin from all sides of a trainee for applying resistance to selected body portions according to a selected exercise.

Figure 3:
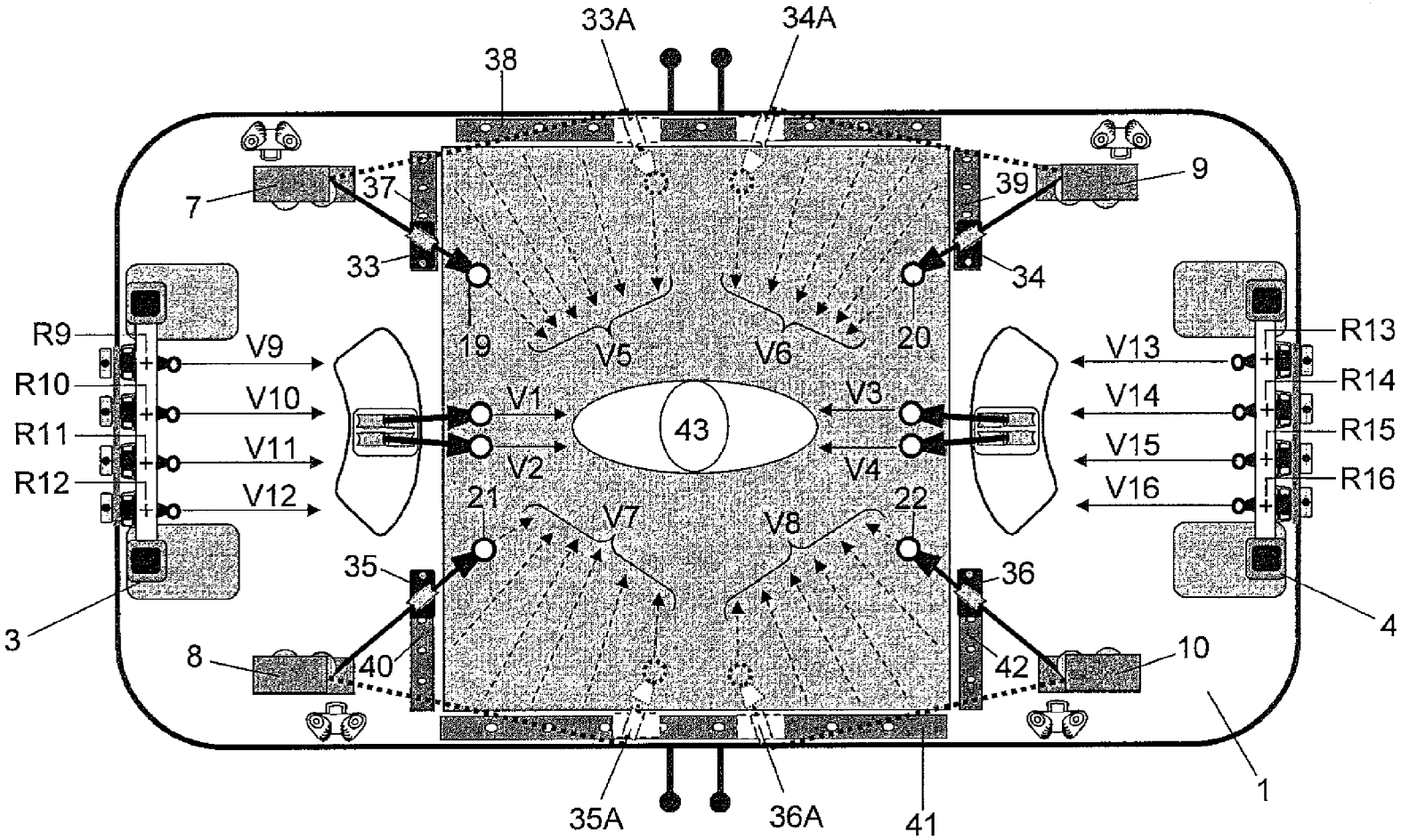
FIG. 3 is a top plan view of a further embodiment of the present disclosure for providing a plurality of training vectors having points of origin variable by direction and elevation to a trainee.

FIG. 3 is a top plan view of yet another embodiment of the present disclosure for providing a plurality of training vectors having points of origin variable by direction and elevation to a trainee. With reference to FIG. 3, the multiple training vectors may be attached to a trainee positioned anywhere on the exercise area 2. For example, training vector grouping V5 illustrates the many points of origin of the training vector provided by the elastic member 19 depending upon the location of the pulley assembly 33 along the rails 37, 38. Furthermore, the training vector groupings V6, V7 and V8 illustrate the multiple points of origin of the training vectors provided by the elastic members 20-22 as the pulley assemblies 34-36 are moved to various exemplary positions along the rails 38-42. Since the pulley assemblies 33-36 may be attached to multiple positions along any rail 37-42, the alternate pulley positions 33A-36A and training vector groupings V5-V8 illustrated in FIG. 3 are illustrative only and are not intended to limit the scope of the invention. As illustrated in FIG. 3, the training vectors V1-V4 provided by elastic members 15-18 may rotate approximately 120 degrees about the tracking assembly pivot points to thereby alter the points of origin of the training vectors V1-V4 provided by the elastic members 15-18. The training vectors V9-V16 provided by the elastic members 23-30 may also rotate 360 degrees about corresponding pivot points R9-R16, respectively, to thereby alter the points of origin of the training vectors V9-V16 provided by the elastic members 23-30.

Figure 5:
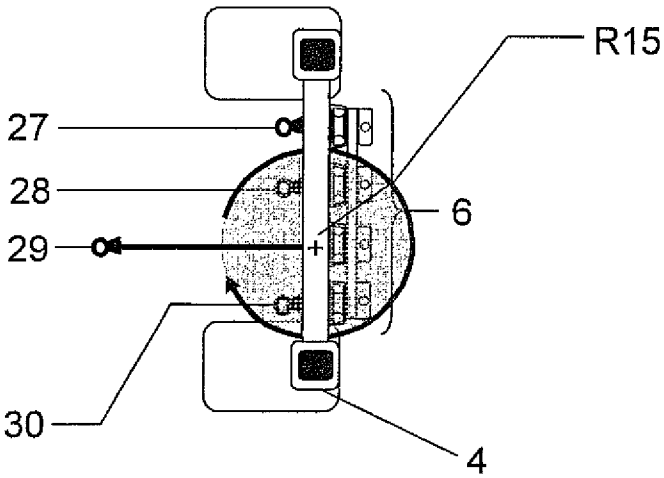
FIGS. 4 and 5 are illustrations of the power module assembly depicting pivoting points of the hanging pulley assemblies of the present disclosure.
Figure 4:
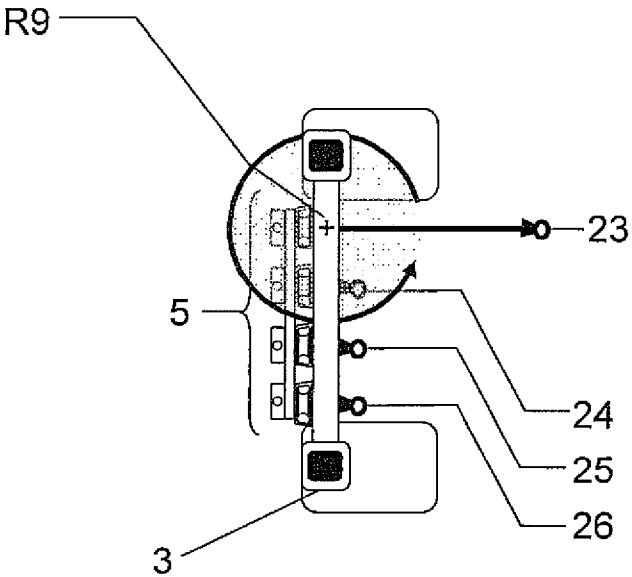

FIGS. 4 and 5 illustrate how the hanging pulley assemblies in the power module assemblies 5, 6 pivot to thereby alter the points of origin of the training vectors. With reference to FIG. 4, the elastic member 23 is adaptable to rotate 360 degrees about its axis R9. At any point during the 360 degree rotation, the elastic member 23 may be extracted and utilized by a trainee for training or exercise purposes. While not illustrated, each of the remaining elastic members 24-26 in the power module assembly 5 possess the same rotational ability depicted for the elastic member 23. With reference to FIG. 5, the elastic member 29 is adaptable to rotate 360 degrees about its axis R15. At any point during the 360 degree rotation, the elastic member 29 may be extracted and utilized by a trainee for training or exercise purposes. While not illustrated, each of the remaining elastic members 27-28 and 30 in the power module assembly 6 possess the same rotational ability depicted for the elastic member 29.

Figure 6:
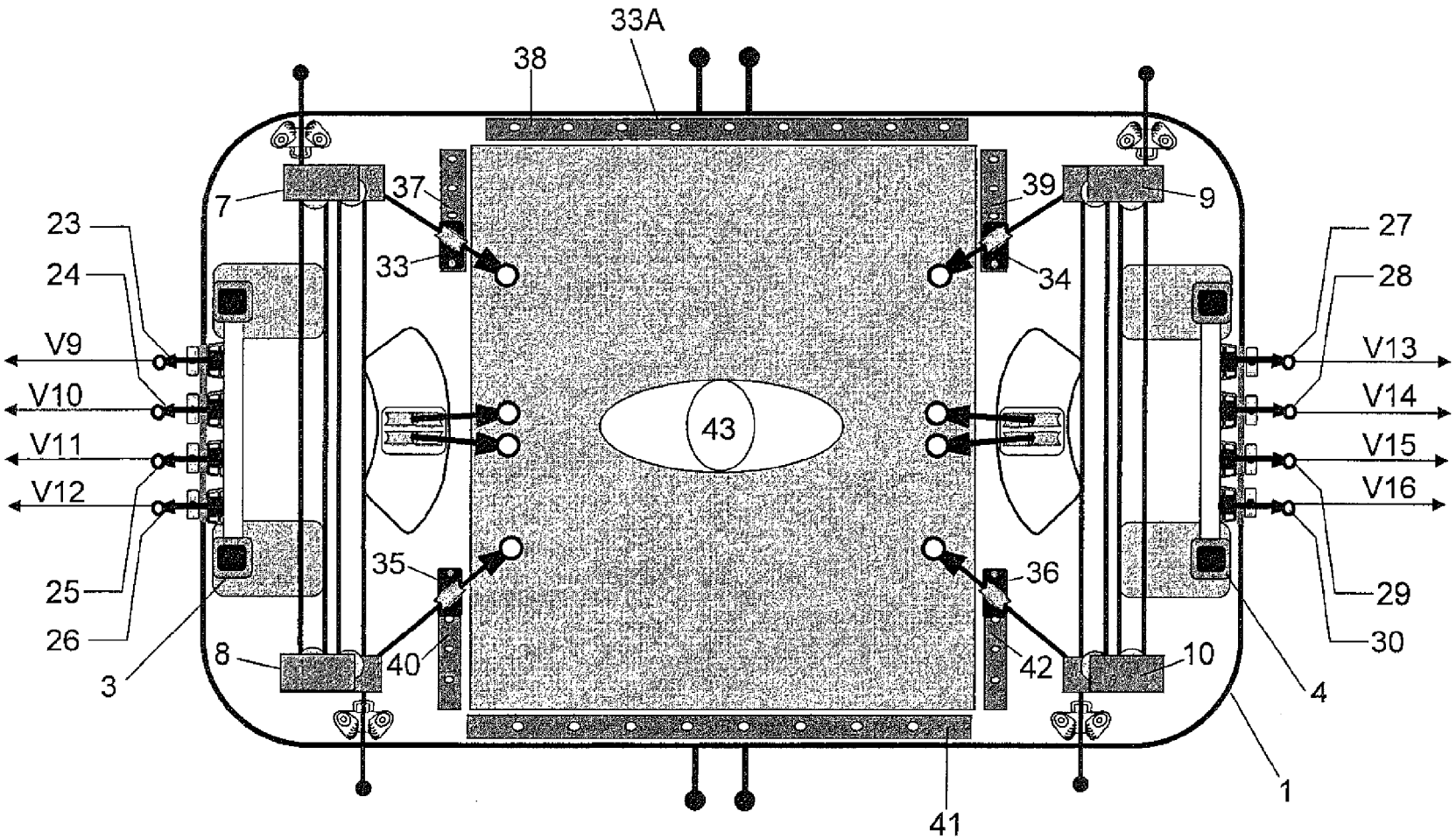
FIG. 6 is a top plan view of an embodiment of the present disclosure for providing a plurality of training vectors having points of origin variable by direction and elevation to a plurality of trainees.

FIG. 6 is a top plan view of a further embodiment of the present disclosure for providing a plurality of training vectors having points of origin variable by direction and elevation to a plurality of trainees. With reference to FIG. 6, the elastic members 23-30 have been rotated 180 degrees relative to each elastic member's respective position illustrated in FIGS. 1-3. Thus, the training vectors V9-V16 are directed away from the platform base 1 to thereby permit additional trainees to train or exercise while positioned off the base 1. As previously noted, the training vectors V9-V16 provided by elastic members 23-30 are adaptable to rotate 360 degrees about corresponding pivot points R9-R16, respectively, to thereby alter the points of origin of the training vectors V9-V16 provided by the elastic members 23-30. Thus, the direction of the training vectors V9-V16 shown by FIG. 6 is illustrative only and is not intended to limit the scope of the invention.

Figure 7:
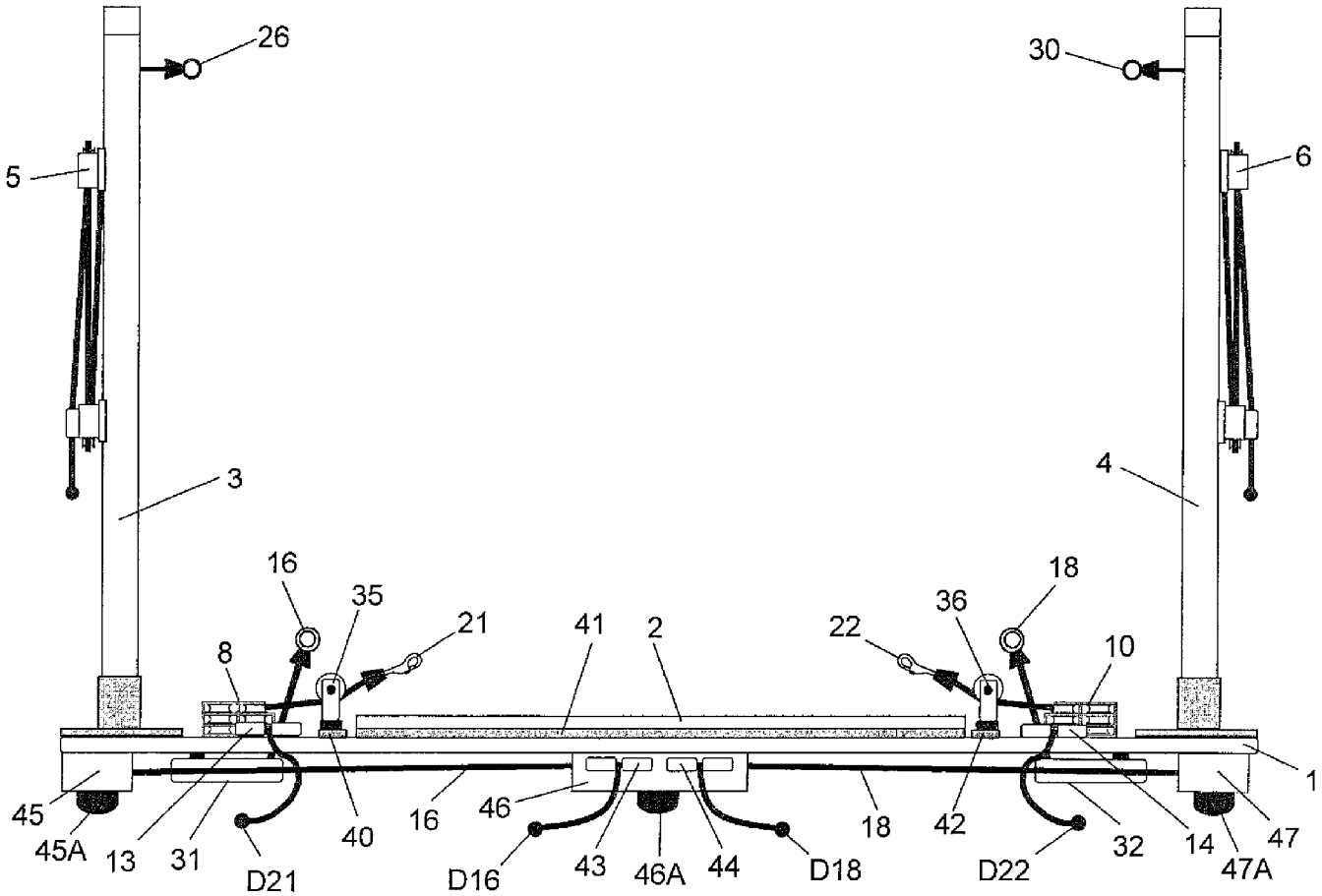
FIG. 7 is a front view of an embodiment of the present disclosure for providing a plurality of training vectors having points of origin variable by direction and elevation to a trainee.

FIG. 7 illustrates a front view of another embodiment of the present disclosure for providing a plurality of training vectors having points of origin variable by direction and elevation to a trainee. With reference to FIG. 7, the elastic members 16, 18 are shown routed from cam assemblies 43, 44 attached to the underside of the base 1 through pulleys provided in the tracking assemblies 31, 32 which provide the point of origin for the training vectors provided by the elastic members 16, 18. The cam assemblies 43, 44 provide a cleating means to adjust the lengths of the elastic members 16, 18 for the purposes of altering the resistance thereof. This may be accomplished by extracting or retracting the distal ends D16, D18 of the elastic members 16, 18 through the cam assemblies 43, 44. The tracking assemblies 31, 32 may rotate about an axis perpendicular to the base 1 and outwardly lateral to the respective tracking assembly 31, 32 thereby allowing the elastic members 16, 18 to track smoothly on the tracking assemblies 31, 32 through the entire range of motion of the body portion of the trainee. Rigid support structures 45-47 house pulley assemblies that route the elastic members 16, 18 from the cam assemblies 43, 44 to the tracking assemblies 31, 32. Pads 45A-47A may be provided on the underside of the rigid support structures 45-47 to protect the surface supporting the base 1 from damage and to provide cushioning or dampening of vibrations induced by a trainee performing training exercises on the apparatus. Thus, the pads 45A-47A may be constructed or molded of any suitable cushioning or dampening material well known in the industry.

With reference to FIG. 7, the tower assemblies 3, 4 are adaptable to slideably house power module assemblies 5, 6 containing the elastic members 23-30. As illustrated, elastic members 23-25 and 27-29 are obstructed from view by the elastic members 26 and 30, respectively. The vertical position of each power module assembly 5, 6 within its respective tower assembly 3, 4 may be changed by a locking mechanism to thereby alter the points and planes of origin of the training vectors provided by the elastic members 23-30.

Figure 9:
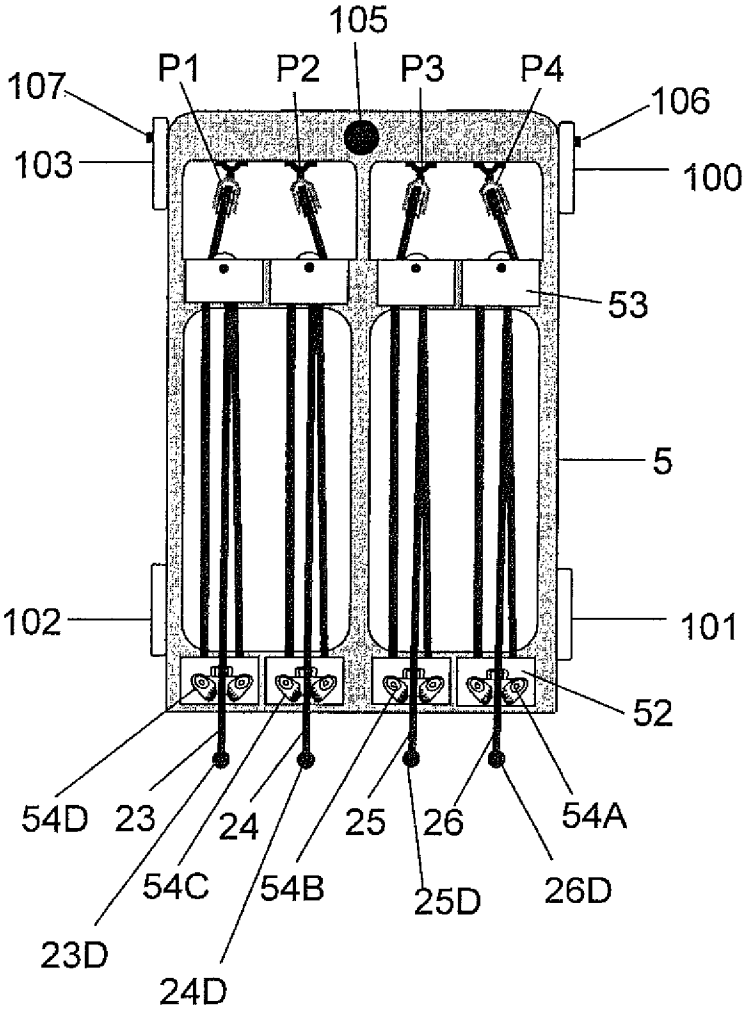
FIG. 9 is a front view of a power module assembly of the present disclosure.
Figure 8:
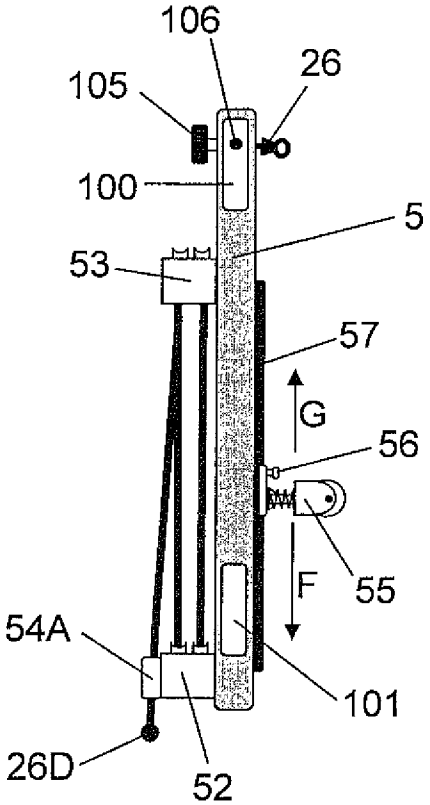
FIG. 8 is a side view of a power module assembly of the present disclosure.
Figure 10:
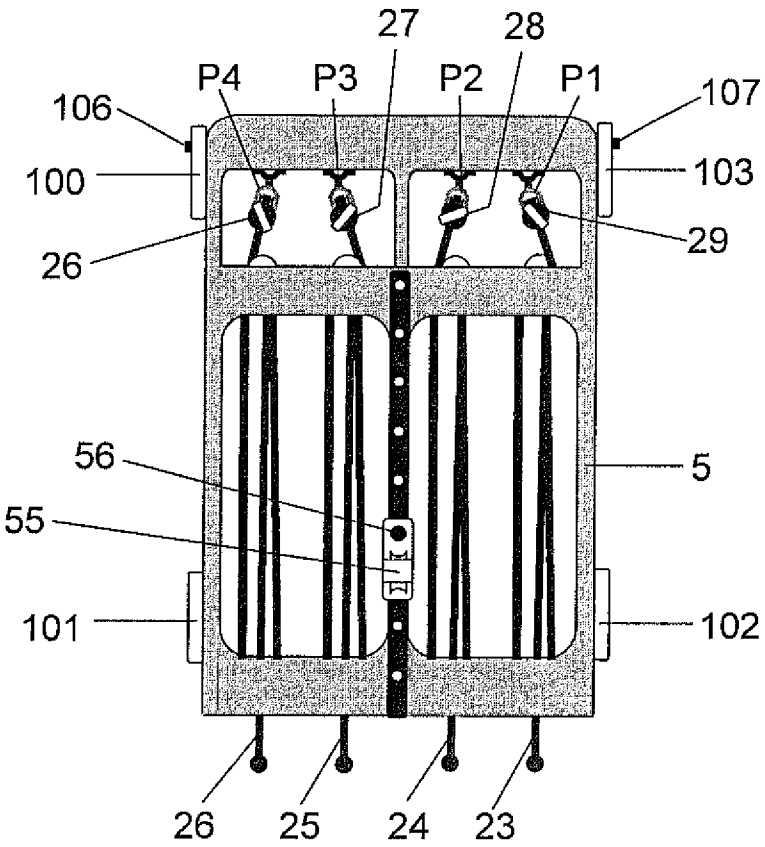
FIG. 10 is a rear view of a power module assembly of the present disclosure.

FIGS. 8, 9 and 10 illustrate the side, front and rear views of the power module assemblies according to the present invention. With reference to FIGS. 8, 9 and 10, the power module assembly 5 comprises a rigid frame that carries a plurality of pulley housing assemblies 52, 53 routing elastic members 23-26 from cam assemblies 54A-54D through the hanging pulley assemblies P1-P4. Each of the pulley housing assemblies 52, 53 includes one or more stacked pulleys. The pulley housing assemblies 52, 53 thus provide a path for routing the elastic members therebetween so that an elastic member many times the distance between corresponding housing assemblies may be utilized. It is also envisioned that a plurality of the training modules disclosed in co-pending U.S. patent application Ser. No. 10/892,568, the contents of which are incorporated by reference herein, may be used in place of the pulley housing assemblies 52, 53.

The hanging pulley assemblies P1-P4 are adaptable to rotate and tilt so that the elastic members 23-26 track smoothly on the hanging pulley assemblies P1-P4 through the entire range of motion of the body portion of the trainee. The power module assembly 5 is identical and interchangeable with power module assembly 6; thus, reference will be made only to the power module assembly 5 and components thereof.

The power module assembly 5 includes a retracting assembly comprising a retracting mechanism 105 operable to retract the locking pins 106, 107. The locking pins 106, 107 may be operably connected to the retracting mechanism 105 via a linkage or spring loaded mechanism to thereby lock the power module assembly 5 in a selected vertical position in the tower assembly 3. A suitable retracting mechanism 105 may be a handle whereby the trainee pulls the handle to retract at least one of the locking pins 106, 107. A further suitable retracting mechanism 105 may also be adaptable to turn clockwise or counter clockwise to retract at least one pin 106, 107. When the retracting mechanism 105 is released, the pins 106, 107 are protracted thereby locking the power module assembly 5 into a selected vertical position in the tower assembly 3. The tracking assemblies 100-103 are mounted on the lateral sides of the power module assembly 5 in contact with the tower assembly 3. The tracking assemblies 100-103 slideably guide the vertical motion of the power module assembly 5 within the confines of the tower assembly 3.

With reference to FIGS. 8 and 10, a movable pulley assembly 55 may be fixed on at least one surface of the power module assembly 5 allowing its position to be set anywhere along a rail 57 as illustrated by arrows F and G. The rail 57 is slotted so that the movable pulley assembly 55 may be positioned along the length of the rail 57. The movable pulley assembly 55 may be fixed at positions along the rail 57 by a suitable locking mechanism 56 such as a spring loaded locking mechanism or other suitable locking means commonly used in the industry. The movable pulley assembly 55 may rotate 360 degrees and tilt +/−90 degrees in any direction so that any one of the elastic members 23-26 tracks smoothly on the movable pulley assembly 55 through the entire range of motion of the body portion of the trainee. It should be noted that multiple movable pulley assemblies may be provided on the rail 57. Furthermore, a plurality of rails and corresponding movable pulley assemblies may be provided on the rigid frame of the power module assembly 5 to vary the point of origin of the training vector provided by any of the elastic members 23-26. Thus, the plane and point of origin of the training vectors provided by the elastic members may be changed independently of the vertical position of the power assembly module 5 in the tower assembly 3. Cam assemblies 54A-54D may be mounted on the pulley housing assemblies 52 to provide a cleating means to adjust lengths of the elastic members 23-26 for the purposes of altering the resistance of the elastic members 23-26. This may be accomplished by extracting or retracting the distal ends 23D-26D of the respective elastic members 23-26 through the cam assemblies 54A-54D. Thus, the magnitude of the training vector will vary with the effective length of the elastic member. Connectors (not shown) may be attached to the elastic members 23-26 whereby the connectors may be connected to harnesses (not shown) worn on body portions of the trainee.

Figure 12:
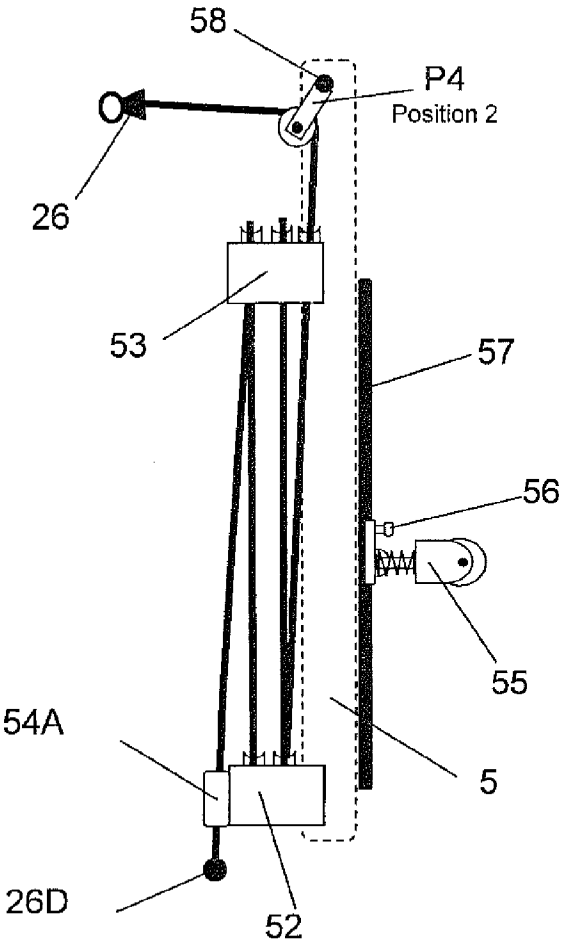
FIGS. 11 and 12 are pictorial views illustrating the rotational capability of an embodiment of a hanging pulley assembly of the present disclosure.
Figure 11:
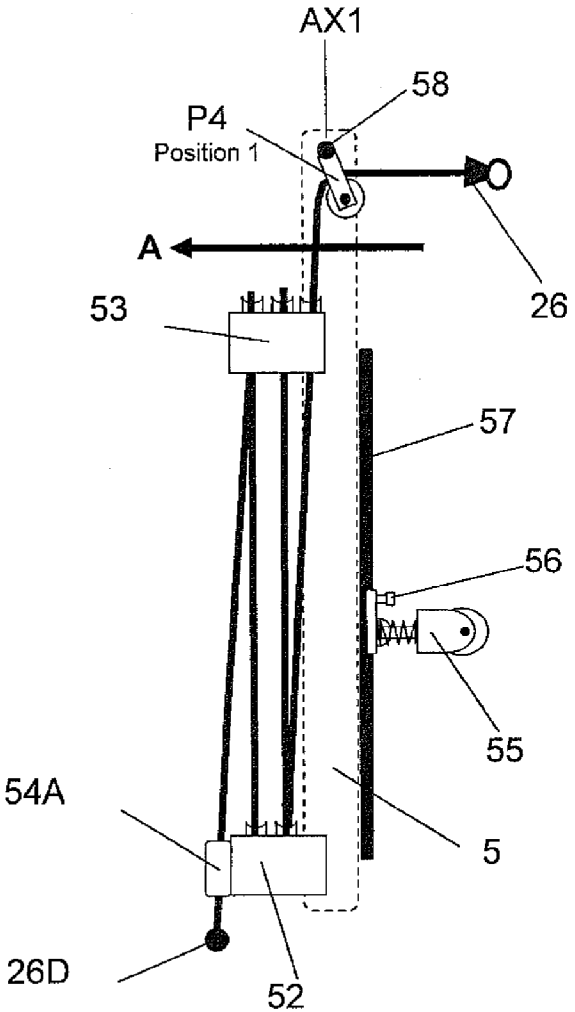

FIGS. 11 and 12 are pictorial views further illustrating the rotational capability of the hanging pulley assemblies P1-P4 shown in FIGS. 9 and 10. The hanging pulley assembly P4 is shown in FIGS. 11 and 12 for demonstrative purposes only and such is not intended to limit the scope of the invention. The hanging pulley assembly P4 is adaptable to pivot on three axes about a point 58. With reference to FIG. 11, the position of the hanging pulley assembly P4 is illustrated when a trainee is training on the exercise area 2 and utilizing the training vector provided by the elastic member 26. If a second trainee, positioned outside the base 1 and lateral to the respective tower assembly 3, desires to utilize the training vector provided by the elastic member 26, the elastic member 26 would be fed under the hanging pulley assembly P4 in the direction illustrated by the arrow A. Upon pulling the elastic member 26 in the direction illustrated by the arrow A, the hanging pulley assembly P4 will rotate 180 degrees about vertical axis AXI and rotate about an axis perpendicular to the page defined by the point 58. It should also be noted that the hanging pulley assembly P4 may also rotate about an axis normal to AXI and the axis defined by the point 58.

With reference to FIG. 12, the position of the hanging pulley assembly P4 is shown after the 180 degree rotation about axis AX1 and approximately 60 degree rotation about the axis defined by point 58 has occurred. The hanging pulley assembly P4 is adaptable to rotate about the axis defined by point 58 by more than 60 degrees and thus, the 60 degree rotation denoted above is illustrative only and is not intended to limit the scope of the invention. Thus, the rotational capabilities of the hanging pulley assemblies P1-P4 and P5-P8 allow a trainee to access and extract elastic members 23-30 from either side of the respective power module assemblies 5, 6.

Figure 13:
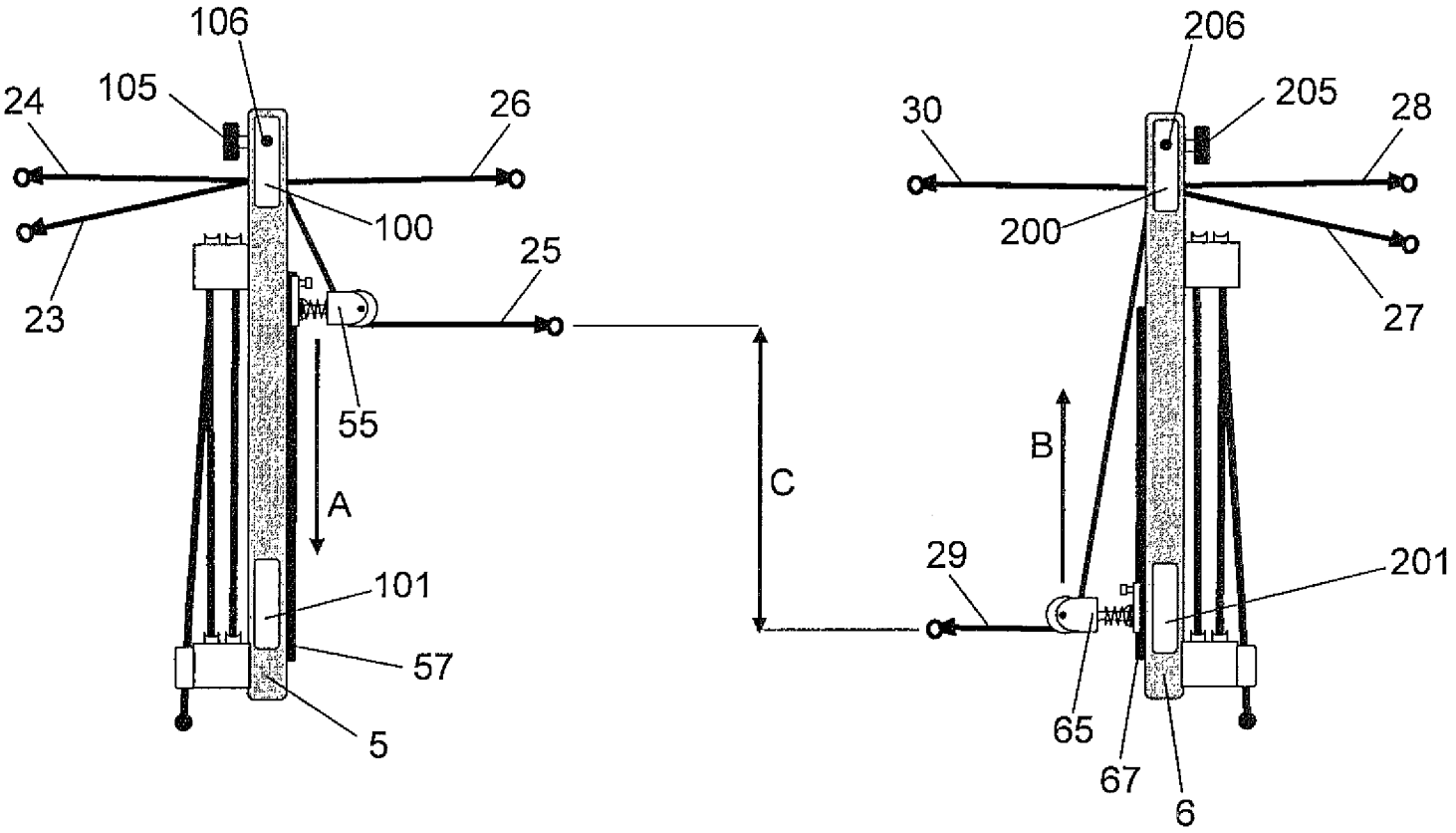
FIG. 13 is side view of a power module assembly of the present disclosure.

FIG. 13 is a side view of the power module assemblies 5, 6 illustrating the vertical adjustment range of movable pulley assemblies 55, 65. With reference to FIG. 13, the movable pulley assembly 55 is positioned at the upper range of elevation adjustment on the rail 57, and the movable pulley assembly 65 is positioned at the lower range of elevation adjustment on the rail 67. Elevation adjustments to the movable pulley assemblies 55, 65 may be made in the directions illustrated by arrows A and B. As a result, any of the elastic members 23-26 and 27-30 may be routed through the movable pulley assemblies 55, 65, respectively, and have their vector origin fixed anywhere along the elevation path illustrated by arrow C without changing the position of the power module assemblies 5, 6.

Figure 14:
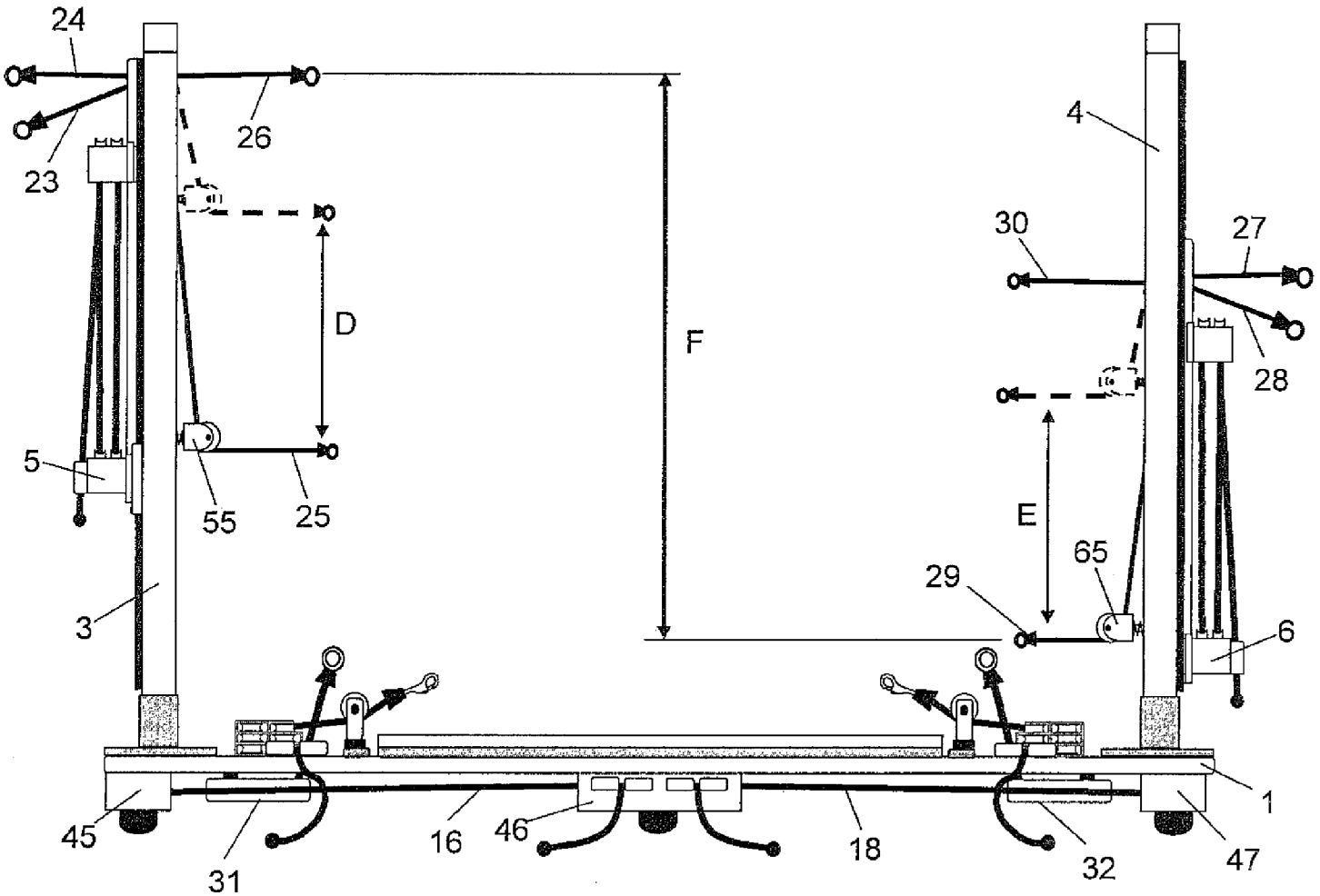
FIG. 14 is a front view of an embodiment of the present disclosure for providing a plurality of training vectors having points of origin variable by direction and elevation to a trainee.
Figure 15:
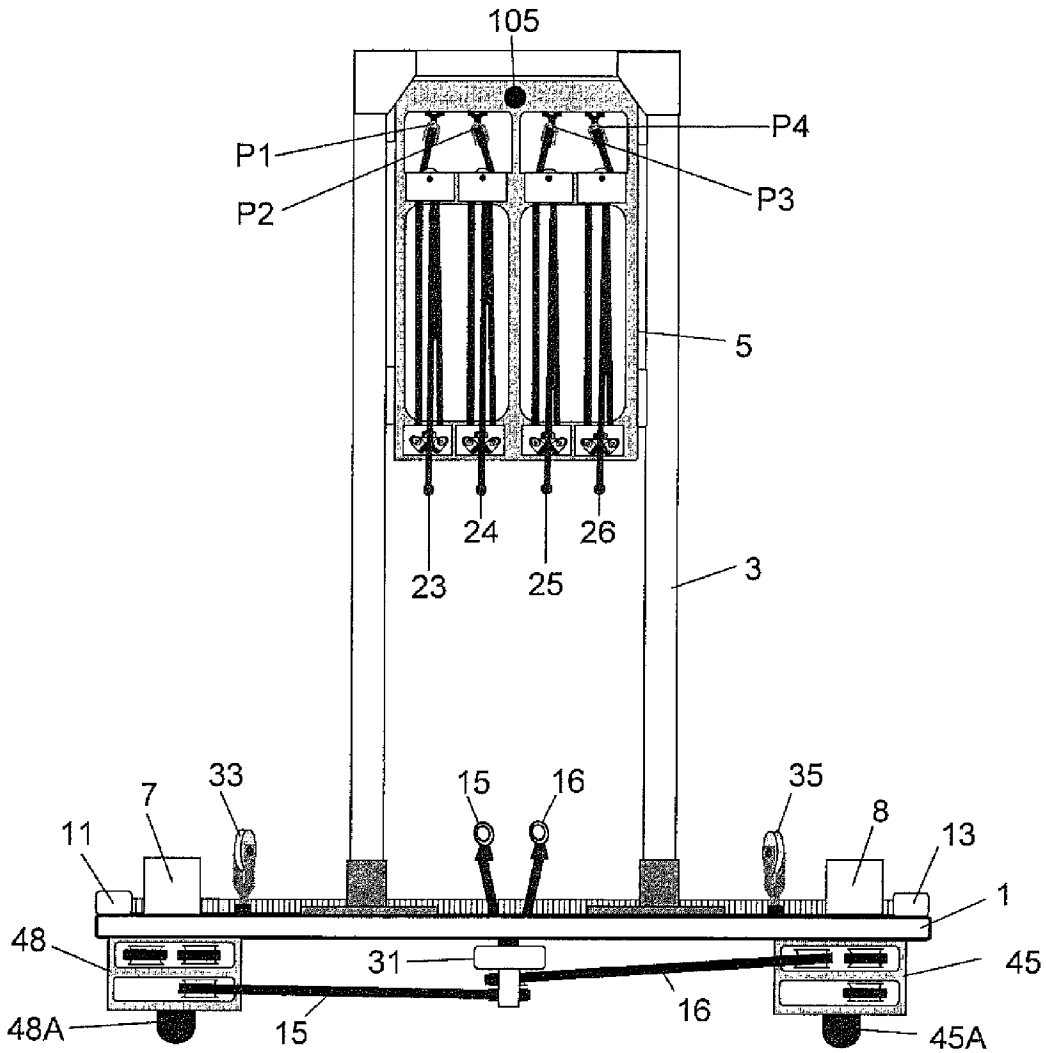
FIGS. 15 and 16 are side views of the embodiment of FIG. 14.
Figure 16:
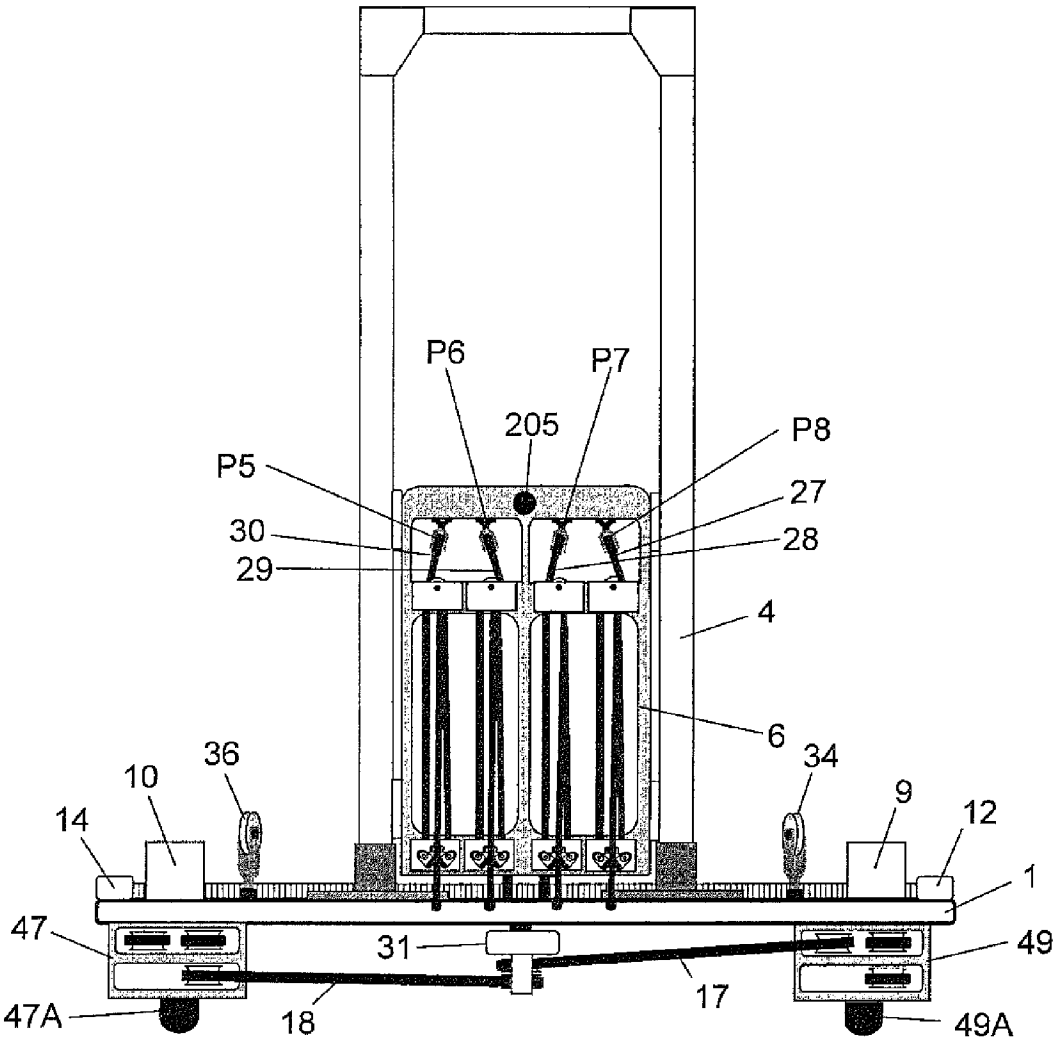

FIGS. 14, 15 and 16 are illustrations of an embodiment of the present disclosure illustrating the full range of elevation adjustments for training vectors provided by the elastic members 23-30. With reference to FIGS. 14, 15, and 16, the power module assembly 5 housed by tower assembly 3 is shown at its highest vertical position. Accordingly, the position of the power module assembly 5 may be the changed to its lowest vertical position as illustrated by the position of the power module assembly 6. The movable pulley assemblies 55, 65 may be positioned at any elevation independent of the position of the power module assemblies 5, 6 as illustrated by arrows D and E. Thus, by vertically positioning power module assemblies 5, 6 in their respective tower assemblies 3, 4 and utilizing the adjustment range D, E of the movable pulley assemblies, 55, 65, the origin of any of the training vectors provided by the elastic members 23-30 may be placed along the elevation range illustrated by the arrow F.

Figure 17:
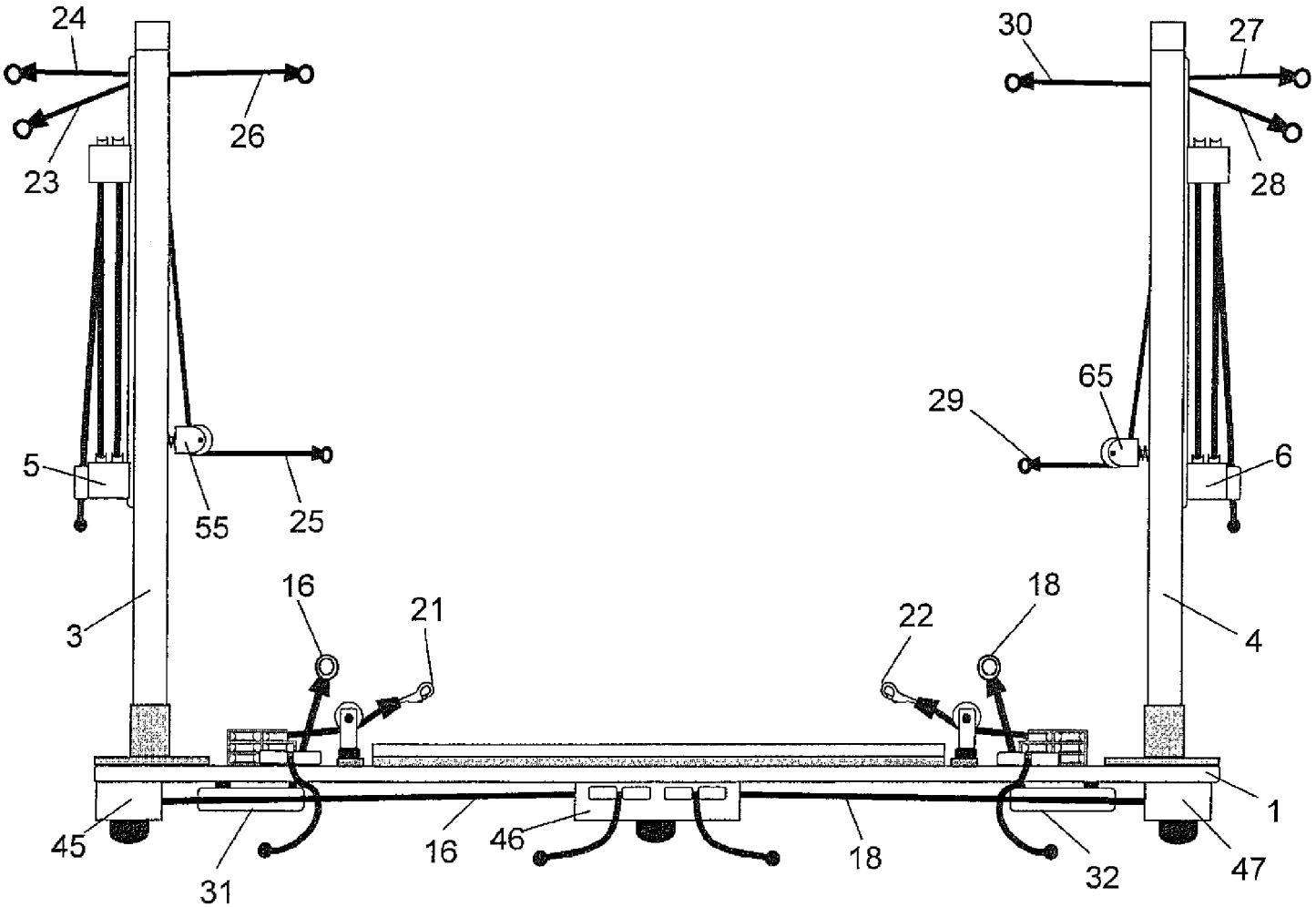
FIG. 17 is a front view of an embodiment of the present disclosure for providing a plurality of training vectors having points of origin variable by direction and elevation to a trainee.

FIG. 17 is a front view of another embodiment of the present disclosure for providing a plurality of training vectors having points of origin variable by direction and elevation to a trainee. With reference to FIG. 17, the power module assemblies 5, 6 housed by the tower assemblies 3, 4 are illustrated at each module's highest vertical position. The movable pulley assemblies 55, 65 are positioned at the lowest elevation independent of the position of the power module assemblies 5, 6. It should be noted that the elastic members utilized in FIG. 17 are for demonstrative purposes only and any of the elastic members of the present invention may be utilized to provide training vectors to any body portion selected by a trainee.

Figure 18:
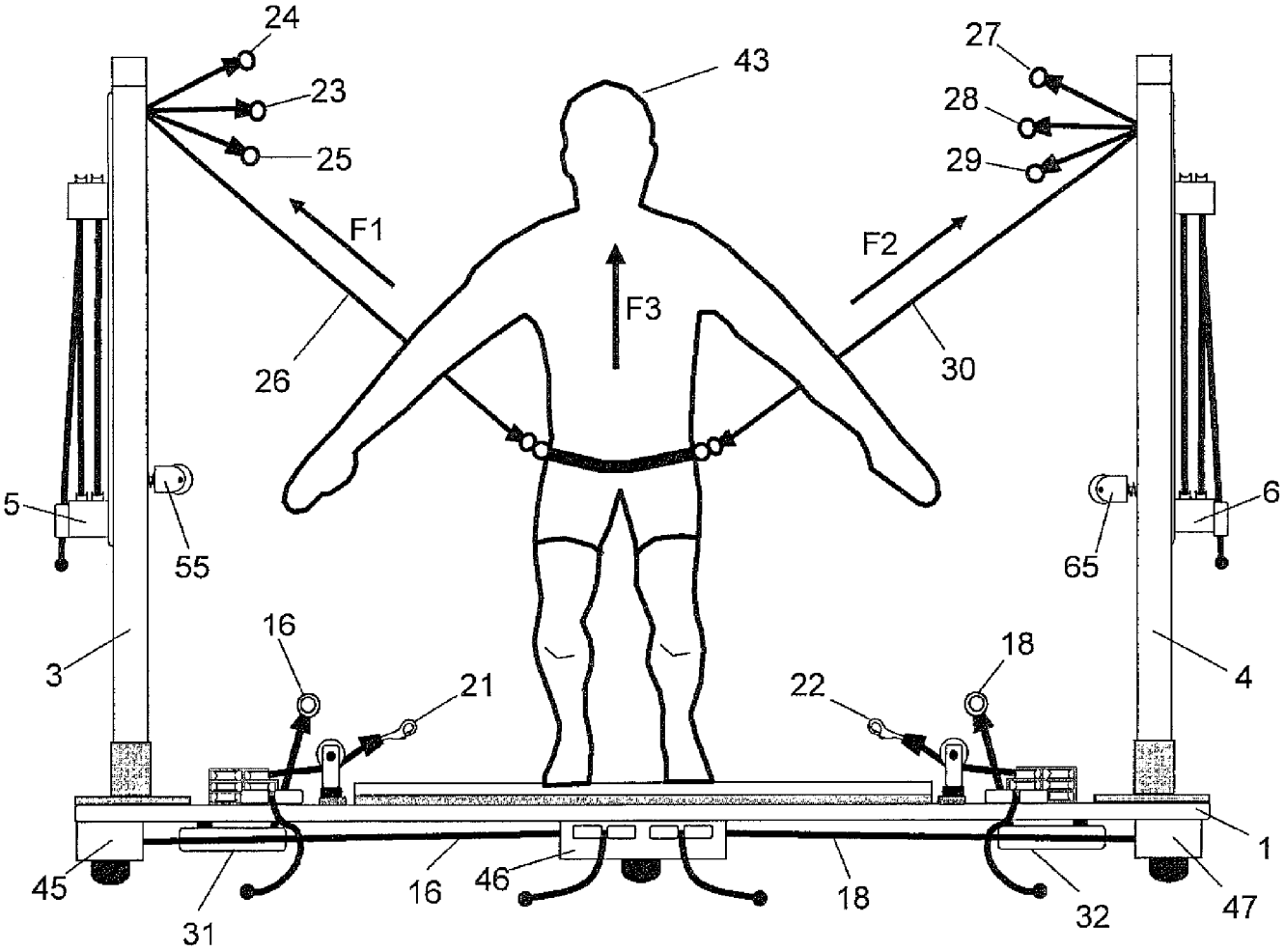
FIG. 18 is an illustration of the training vectors associated with an embodiment of the present disclosure showing a trainee in a crouched position.
Figure 19:
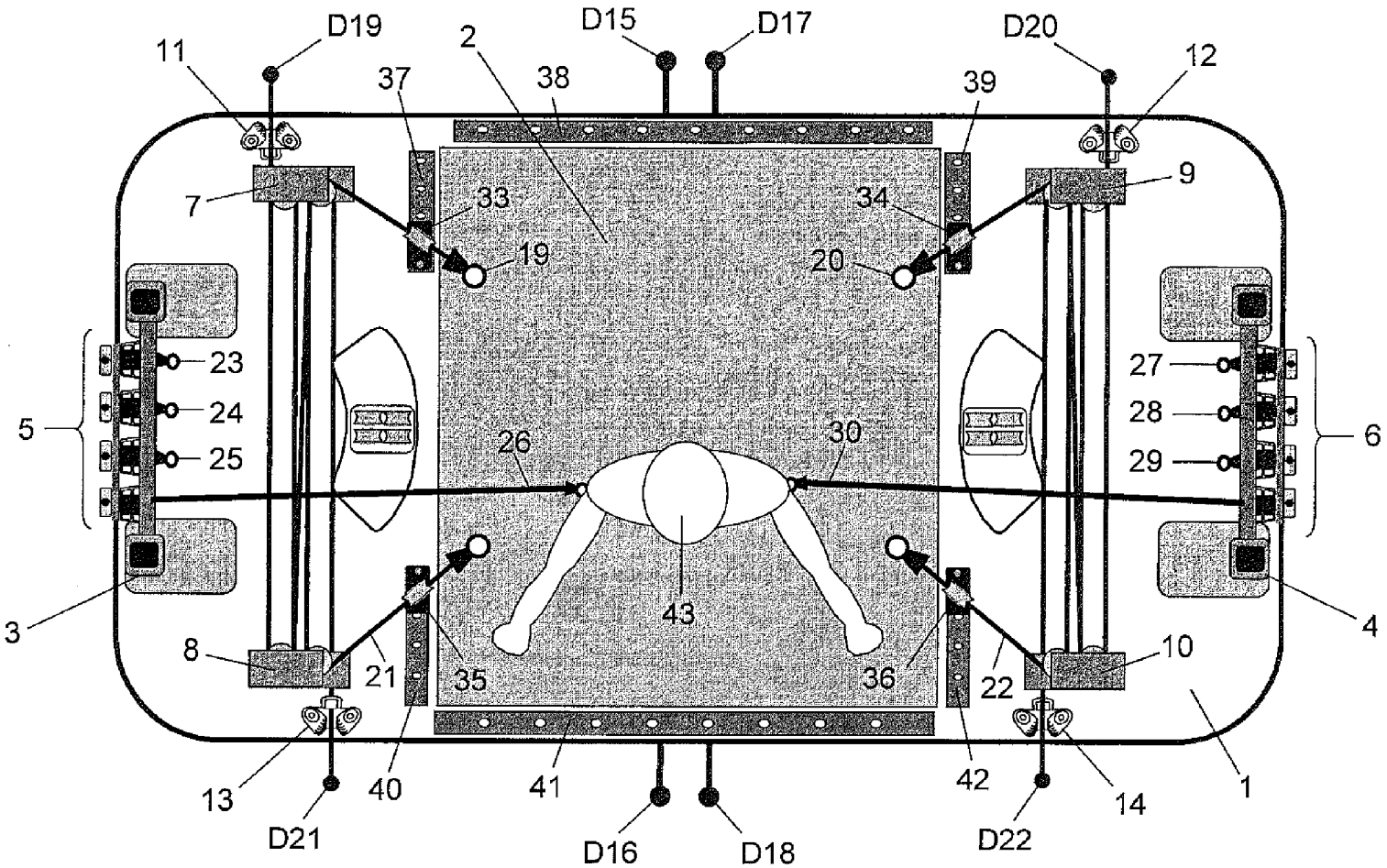
FIG. 19 is a top plan view of the embodiment of FIG. 18.

FIGS. 18 and 19 illustrate front and top plan views of one embodiment of the physical training apparatus for providing training vectors to a trainee. With reference to FIGS. 18 and 19, training vectors F1 and F2 provided by the elastic Members 26, 30 are applied to the waist of the trainee 43. Since the training vectors F1 and F2 possess an origin at the highest elevation of the respective power module assemblies 5, 6, the training vectors F1 and F2 act to provide a net lifting force vector F3 to the waist of the trainee 43.

Figure 20:
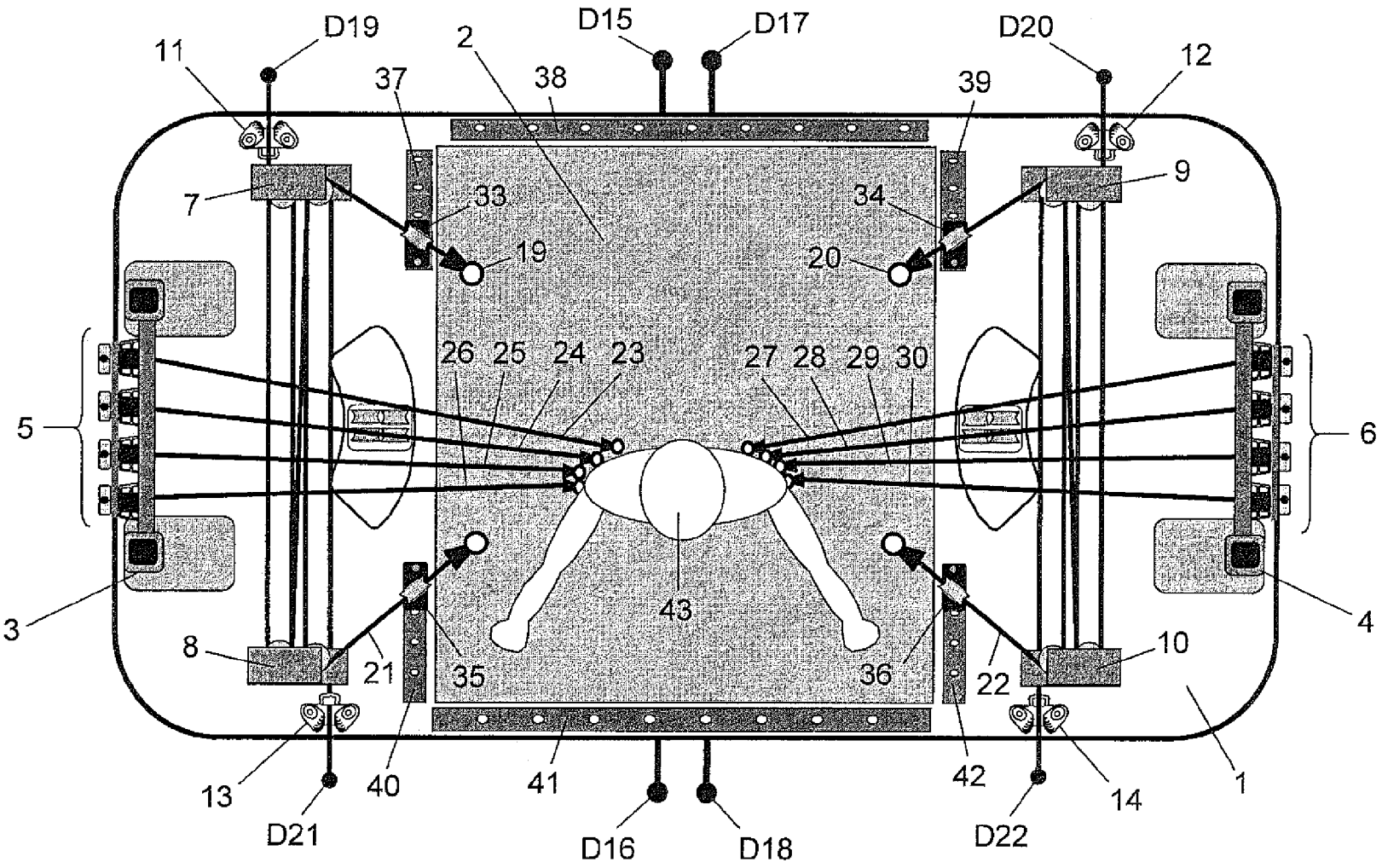
FIG. 20 is a top plan view of an embodiment of the present disclosure providing eight training vectors to a trainee.

FIG. 20 illustrates a top plan view of a further embodiment of the physical training apparatus for providing training vectors to a trainee. With reference to FIG. 20, each of the elastic members 23-26 originating from the power module assembly 5 and each of the elastic members 27-30 originating from the power module assembly 6 are attached to the waist of the trainee 43 to thereby maximize the upward lifting force vector F3 illustrated in FIG. 18. Thus, as each additional elastic member is connected to the waist harness of the trainee 43, the loading on the trainee's legs will decrease proportionally by the amount of resistance applied by the elastic member. Accordingly, the magnitude of the lifting force vector F3 may be altered by varying the effective length of the elastic members 23-30 or by adding resistance training vectors by the elastic members 15-22.

Figure 21:
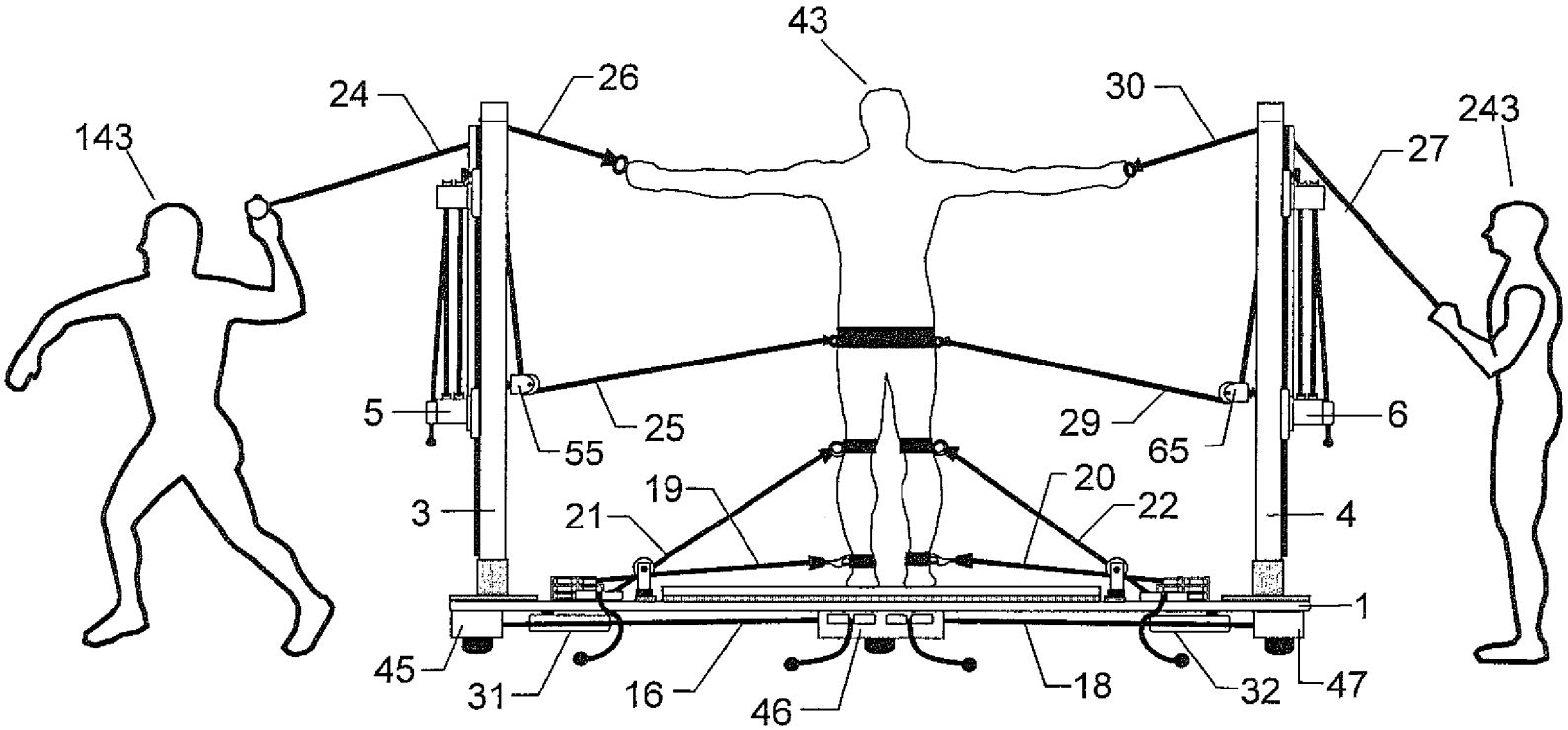
FIG. 21 is front view of an embodiment of the present disclosure providing eight training vectors having points of origin variable by direction and elevation to one trainee and providing training vectors to two other trainees simultaneously.

FIGS. 21-25 illustrate embodiments of the physical training apparatus of the present invention for providing a plurality of training vectors having points of origin variable by direction and elevation to at least one trainee. With reference to FIG. 21, an embodiment of the present invention is illustrated providing eight training vectors having points of origin variable by direction and elevation to one trainee and providing training vectors to two other trainees simultaneously. As illustrated in FIG. 21, the elastic members 21, 22 are attached to the knees of the trainee 43 and the elastic members 19, 20 are attached to the ankles of the trainee 43. The elastic members 25, 29 are routed through the power module assemblies 5; 6 and through the movable pulley assemblies 55, 65 and attached to the waist of the trainee 43 and the elastic members 26, 30 are routed through the power modules assemblies 5, 6 and attached to the hands of the trainee 43. While the trainee 43 is conducting his or her training or therapeutic exercises, a second trainee 143, exercising off the base 1, may be performing another independent exercise. In this illustration, the elastic member 24 has been attached to a ball and thereby provides a resistance training vector to the second trainee 143 conducting a throwing motion. A third trainee 243, exercising off the base 1, may also be performing another independent exercise. With reference to FIG. 21, a training vector is provided to the trainee 243 by the elastic member 27 while he or she is performing a triceps exercise.

While not shown, the trainee 43 may utilize any of the remaining training vectors provided by unused elastic members having a point of origin from the base 1 or from the tower assemblies 3, 4. Furthermore, the second trainee 143 may utilize any of the remaining training vectors provided by unused elastic members having a point of origin from the tower assembly 3, and the third trainee 243 may utilize any of the remaining training vectors provided by unused elastic members having a point of origin from the tower assembly 4. It should be noted that the magnitude of each of the training vectors supplied by the present invention may be independently varied with the effective length of the corresponding elastic member.

Figure 22:
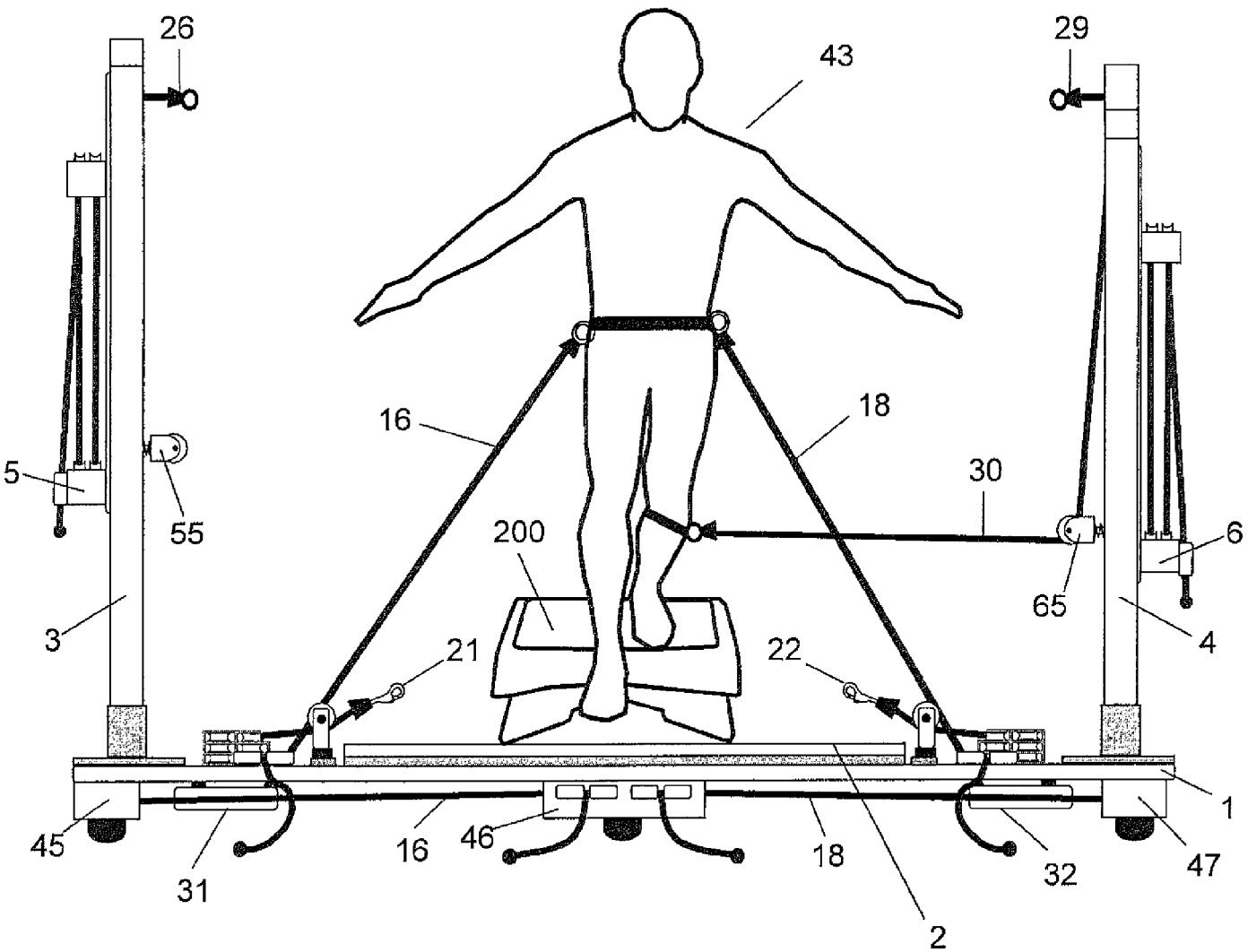
FIG. 22 is front view of an embodiment of the present disclosure providing an unbalanced loading comprising at least three training vectors to a trainee.

With reference to FIG. 22, a further embodiment of the present invention is illustrated providing three training vectors having points of origin variable by direction and elevation to a trainee. An unbalanced training vector configuration is illustrated in FIG. 22 whereby an unbalanced resistance may be applied to a trainee 43 to exercise specialized muscle groups that would otherwise not be challenged during an exercise motion with any prior art exercise apparatuses. With reference to FIG. 22, a trainee 43 is shown performing a stepping exercise. Training vectors are applied to the waist or hips of the trainee 43 by the elastic members 16, 18 while a third training vector is applied to the trainee's left knee. In this instance, as the trainee's left knee bends to allow the right foot to make contact with the exercise area 2, the training vector supplied by the elastic member 30 will activate muscles on the inside of the trainee's left leg that are not normally activated when stepping down.

Figure 23:
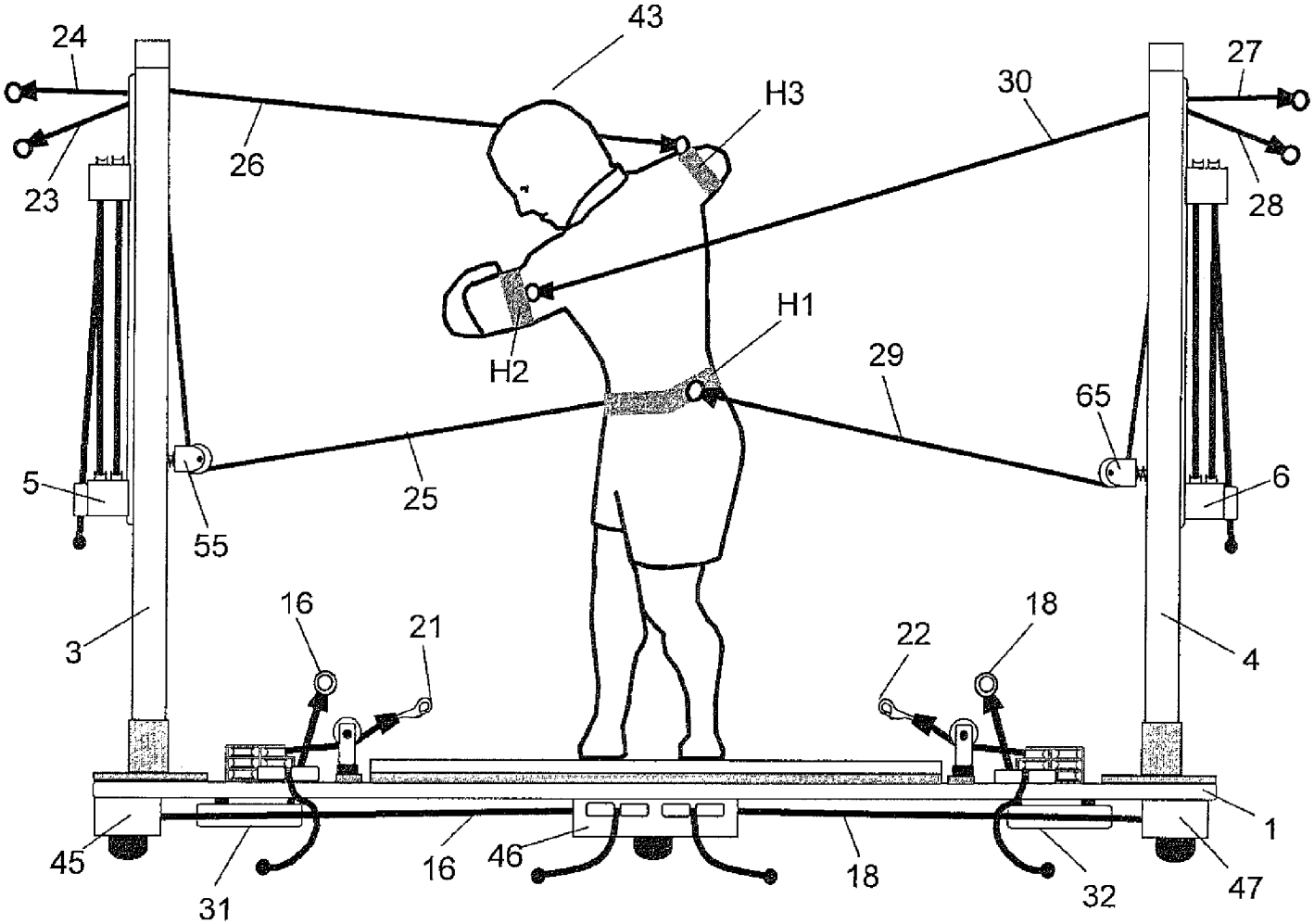
FIG. 23 is a front view of an embodiment of the present disclosure with a trainee performing a swinging exercise.

With reference to FIG. 23, an embodiment of the present disclosure is shown with a trainee performing a swinging motion. FIG. 23 illustrates the ability of the present invention to apply balanced torque at multiple planes to a trainee. The application of such balanced torque is helpful towards strengthening muscles associated with swinging a golf club, baseball bat, or tennis racket. For example, the elastic members 25, 29 are attached to the right and left hips of the trainee 43 by a harness H1. The elastic member 30 is attached to the left shoulder of the trainee 43 by a harness H2 and the elastic member 26 is attached to the right shoulder of the trainee 43 by a harness H3. As the trainee 43 rotates to a back swing position, all of the elastic members 25, 26, 29, 30 provide resistance training vectors into the back swing or coiled position while assisting the swinging motion of the trainee 43 from the back swing position through the mid-swing and follow-through positions. The application of the training vectors provided by the elastic members 25, 26, 29, 30 thus strengthen all the muscles associated with a back swing in this manner.

If the trainee 43 rotates to his or her left 180 degrees and then coils to a back swing position, the elastic members 25, 26, 29, 30 assist the back swing or coiled position while resisting the swinging motion of the trainee 43 from the back swing position through the mid-swing and follow-through positions. The application of the training vectors provided by the elastic members 25, 26, 29, 30 thus strengthen all the muscles associated with the down swing in this manner. Accordingly, a trainee 43 may reposition the elastic members 25, 26, 29 30 such that the elastic member 26 is attached to the left shoulder, the elastic member 30 is attached to the right shoulder, and the elastic members 25, 29 are attached to the left and right hips, respectively, of the trainee 43. Thus, the training vectors provided by the elastic members 25, 26, 29, 30 will assist the trainee into a backswing or coiled position and provide resistance training vectors through the mid-swing and follow-through positions. In this manner, if the trainee 43 rotates to his or her left 180 degrees and then rotates to a back swing position, the elastic members 25, 26, 29, 30 will resist the back swing or coiled position while assisting the swinging motion of the trainee 43 from the back swing position through the mid-swing and follow-through positions.

The magnitude of each of the training vectors may be varied with the effective length of the respective elastic members. For example, the elastic members 25 and 29 may have sufficient length so that the magnitude of the training vectors provided to the hips of the trainee is greater than the magnitude of the training vectors provided to the shoulders of the trainee via the elastic members 26 and 30. In a further embodiment of the present disclosure, elastic members having different diameters may be utilized for providing a wider range of resistive force. It is also envisioned that the training modules disclosed in co-pending U.S. patent application Ser. No. 10/892,568, the contents of which are incorporated by reference herein, may be utilized, stacked or combined to increase the useful resistance force range.

Figure 24:
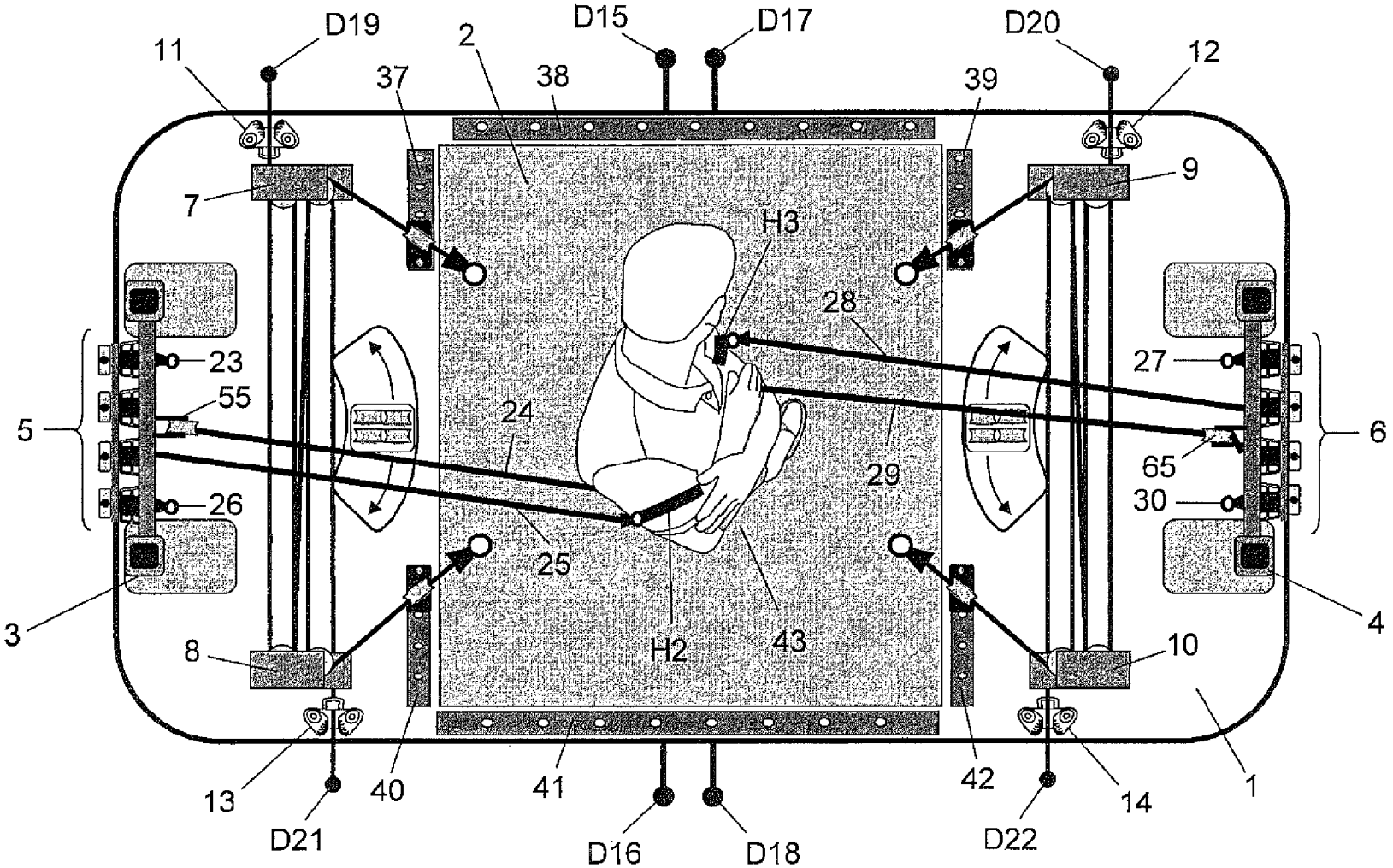
FIG. 24 is a top plan view of an embodiment of the present disclosure with a trainee performing a swinging exercise.

With reference to FIG. 24, another embodiment of the present disclosure is shown with a trainee performing a swinging motion. FIG. 24 further illustrates the ability of the present invention to apply balanced torque on multiple planes to a trainee. In the embodiment shown, the elastic members 24, 25, 28, 29 are utilized to exercise specific muscle groups of the trainee while performing a swinging motion. The elastic member 28 is attached to the left arm by the harness H3 and the elastic member 25 is attached to the right arm by the harness H2. The elastic member 29 is attached to the left hip with the harness H1 (not shown) and the elastic member 24 is attached to the right hip with the harness H1 (not shown). The movable pulley assemblies 55, 65 lower the elevation of the elastic members 24, 29 to thereby change the point and plane of origin of the training vectors provided by the elastic members 24, 29. In such a configuration, elastic members apply clockwise torque at the hips and shoulders thus helping the trainee 43 coil in the clockwise direction. When the trainee performs a swinging motion and uncoils in the counter-clockwise direction, the elastic members 24, 25, 28, 29 provide resistance training vectors. Thus, the trainee 43 will be working against the torque applied by the elastic members 24, 25, 28, 29 through the complete counter-clockwise motion. If the trainee 43 reverses his or her position and faces the rail 41, the torque applied to his or her body will reverse. Thus, the elastic members 24, 25, 28, 29 provide resistance training vectors to the clockwise rotation or back swing motion of the trainee 43 and act to assist counter-clockwise rotation or down swing and follow through motion of the trainee 43.

Figure 25:
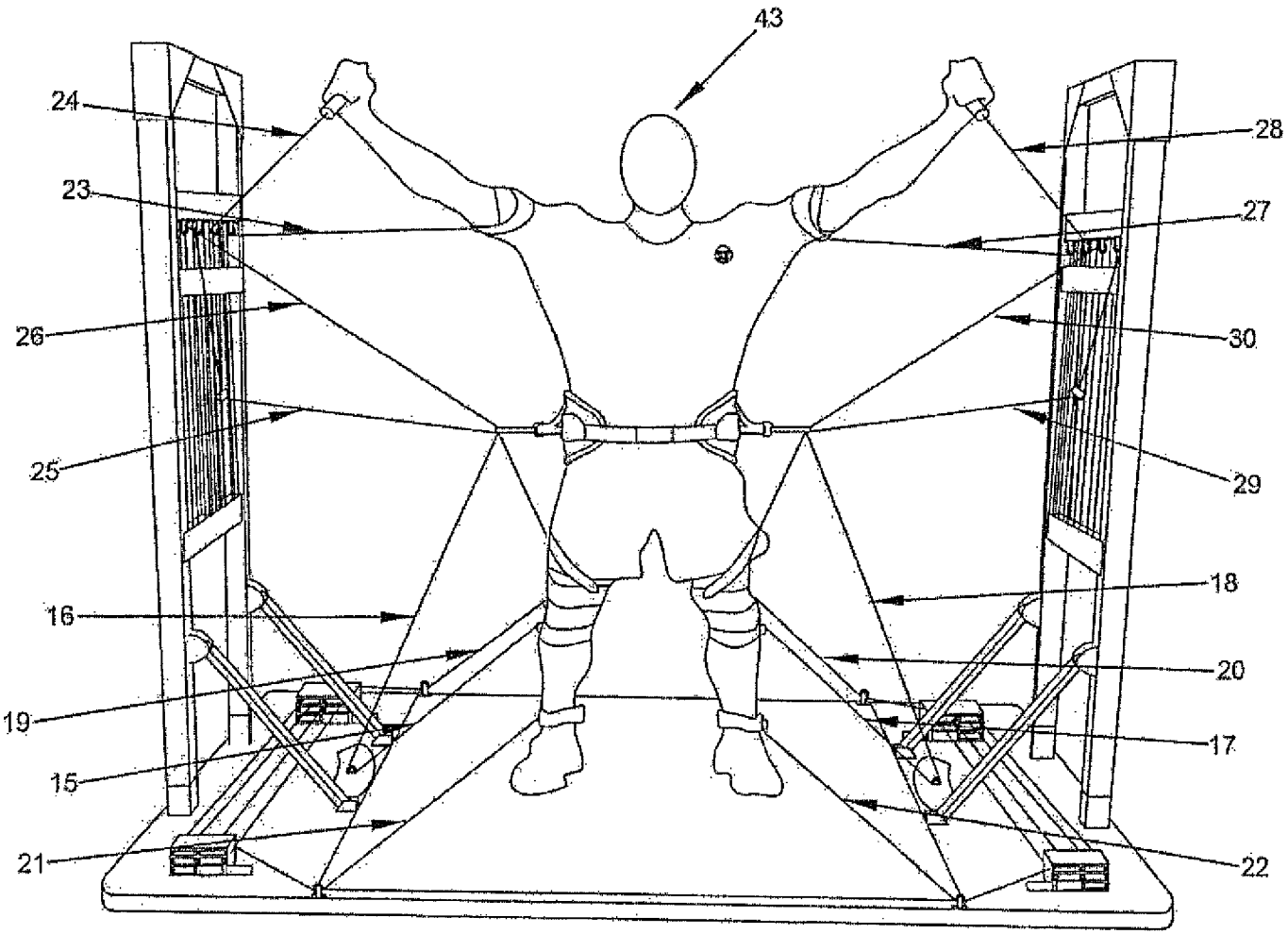
FIG. 25 is an isometric view of an embodiment of the present disclosure providing sixteen training vectors having points of origin variable by direction and elevation to one trainee.

With reference to FIG. 25, yet another embodiment of the present invention is illustrated providing sixteen training vectors having points of origin variable by direction and elevation to one trainee. For example, FIG. 25 illustrates the trainee 43 utilizing a plurality of training vectors applied to the upper torso area by four elastic members 23, 24, 27, 28, to the waist by six elastic members 16, 18, 25, 26, 29, 30, and to the lower extremities of the trainee 43 by six elastic members 15, 17, 19-22. The magnitude of each of the training vectors may be independently adjusted relative to the magnitude of the other training vectors. It should be noted that any of the elastic members 15-30 may be utilized alone or in any of a multitude of combinations by the trainee 43 to thereby exercise specific muscle groups of the trainee 43 throughout an entire range of motion.

Figure 26:
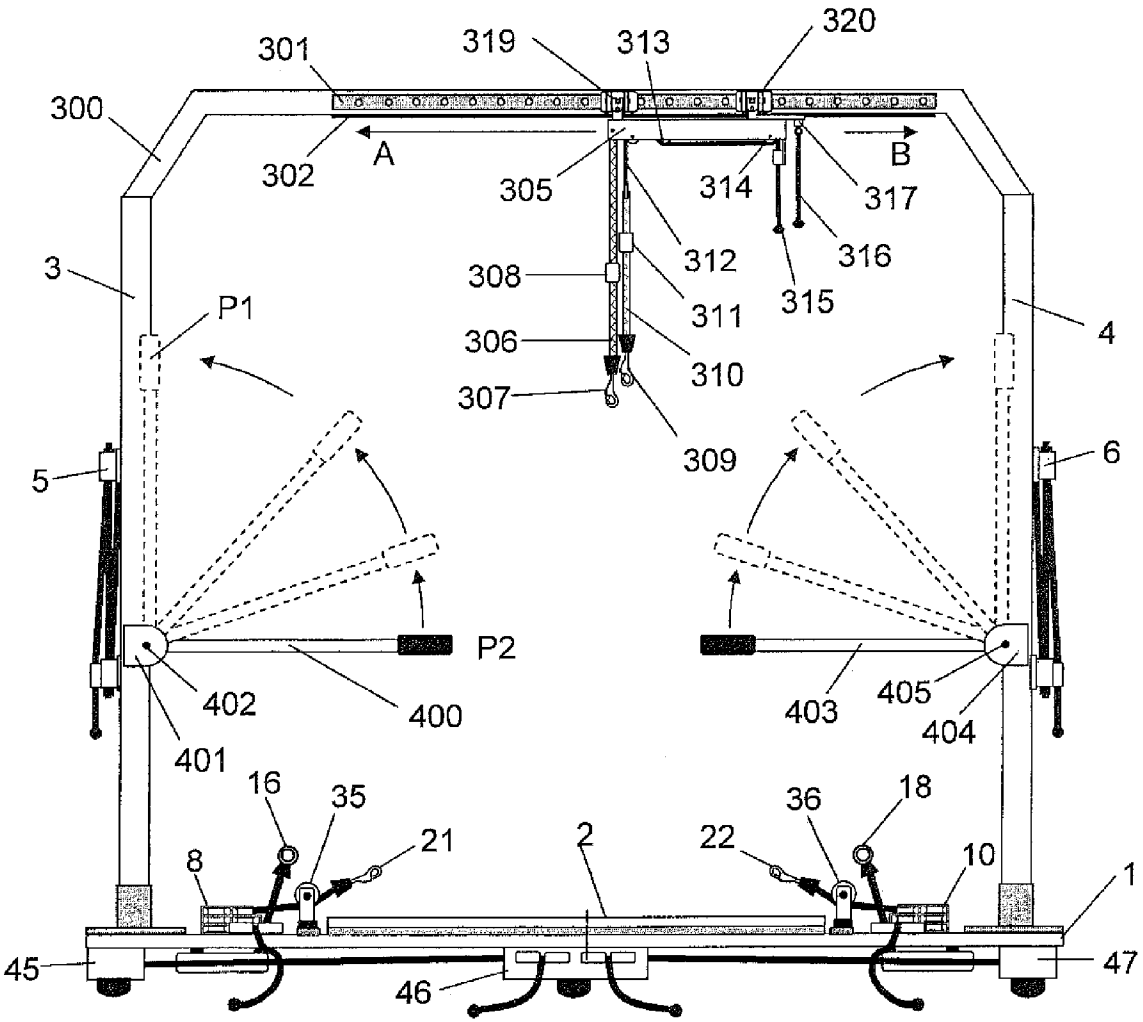
FIG. 26 is a front view of an embodiment of the present disclosure providing training vectors having points of origin variable by direction and elevation to one trainee further providing an overhead support structure.
Figure 27:
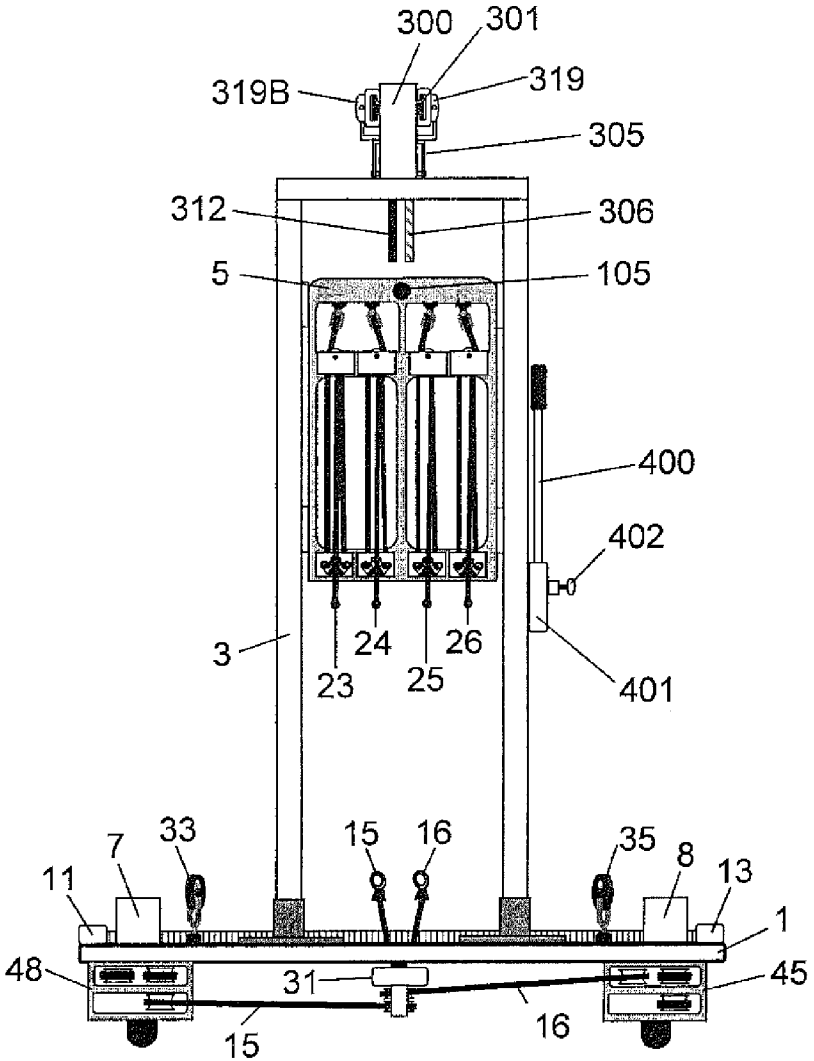
FIG. 27 is a side view of the embodiment of FIG. 26.

FIGS. 26 and 27 illustrate a further embodiment of the present disclosure providing training vectors having points of origin variable by direction and elevation to one trainee and further providing an overhead support structure to provide support for patients or trainees who cannot fully support their own body weight. With reference to FIG. 26, an overhead support structure 300 extends between and is securely mounted to the crown of both tower assemblies 3, 4. The overhead support structure 300 may be adaptable to be easily removed by a trainee or therapist. A trolley assembly 305 is slideably mounted to the overhead support structure 300 by a plurality of sliding guides 319, 320 and 319B, 320B (not shown). The sliding guides 319, 319B, 320, 320B slide on rails 301, 301B, 302 affixed to the overhead support structure 300. The rails 301, 301B, 302 are slotted so that the trolley assembly 305 may be positioned along the length of the rails 301, 301B, 302 in the directions illustrated by arrows A and B. The trolley assembly 305 may also be adaptable to lock in place on the rails 301, 301B, 302 by any suitable locking means such as spring loaded locking mechanisms. One suitable locking means is a locking member 316 operably attached to a locking pin 317. When the locking member 316 is pulled, the trolley assembly 305 is allowed to freely slide along the rails 301, 301B, 302. When the locking member 316 is released, the locking pin 317 engages at least one rail and locks the trolley assembly 305 in place. The trolley assembly 305 further comprises a plurality of tracking mechanisms 325 which route a retraction cable 312 from a gliding assembly (not shown) to a hoisting member 310 having a connector 309 attached thereto for attaching to a harness (not shown) worn by a trainee or patient. A hoisting cable 315 is affixed at one end to the gliding assembly (not shown) via tracking mechanisms 313, 314. The trolley assembly 305 further comprises a safety member 306 having a suitable connector 307 at the distal end thereof for attachment to a trainee or patient.

The tracking mechanisms preferably comprise a combination of fixed pulley assemblies 314, 325 and slidable pulley assemblies 313 which, when the hoisting cable 315 is operated, act to lift a trainee or patient attached to the hoisting member 310 for therapeutic exercises. Adjustment buckles 308, 311 are provided on the safety member 306 and hoisting member 310, respectively, allowing for length adjustment thereof. At least two rotating support structures 400, 403 may be mounted to the tower assemblies 3, 4 to provide balance and support for patients of varying height. The rotating support structures 400, 403 are adaptable to lock at several different angles. Patients or trainees may utilize the support structures 400, 403 to help balance themselves while the hoisting and safety members are being attached to their bodies, or the patients or trainees may utilize the support structures during athletic or therapeutic exercises. The support structures 400, 403 are rotatably mounted to support bases 401, 404 affixed to the tower assemblies 3, 4. The support bases 401, 404 further comprise a locking means 402, 405 to thereby lock the structures 400, 403 in many positions ranging from a horizontal position P2 to a vertical stow position P1. Any suitable locking means 402, 405 such as spring loaded locking mechanisms or pins may be utilized to lock the support structures 400, 403.

Figure 28:
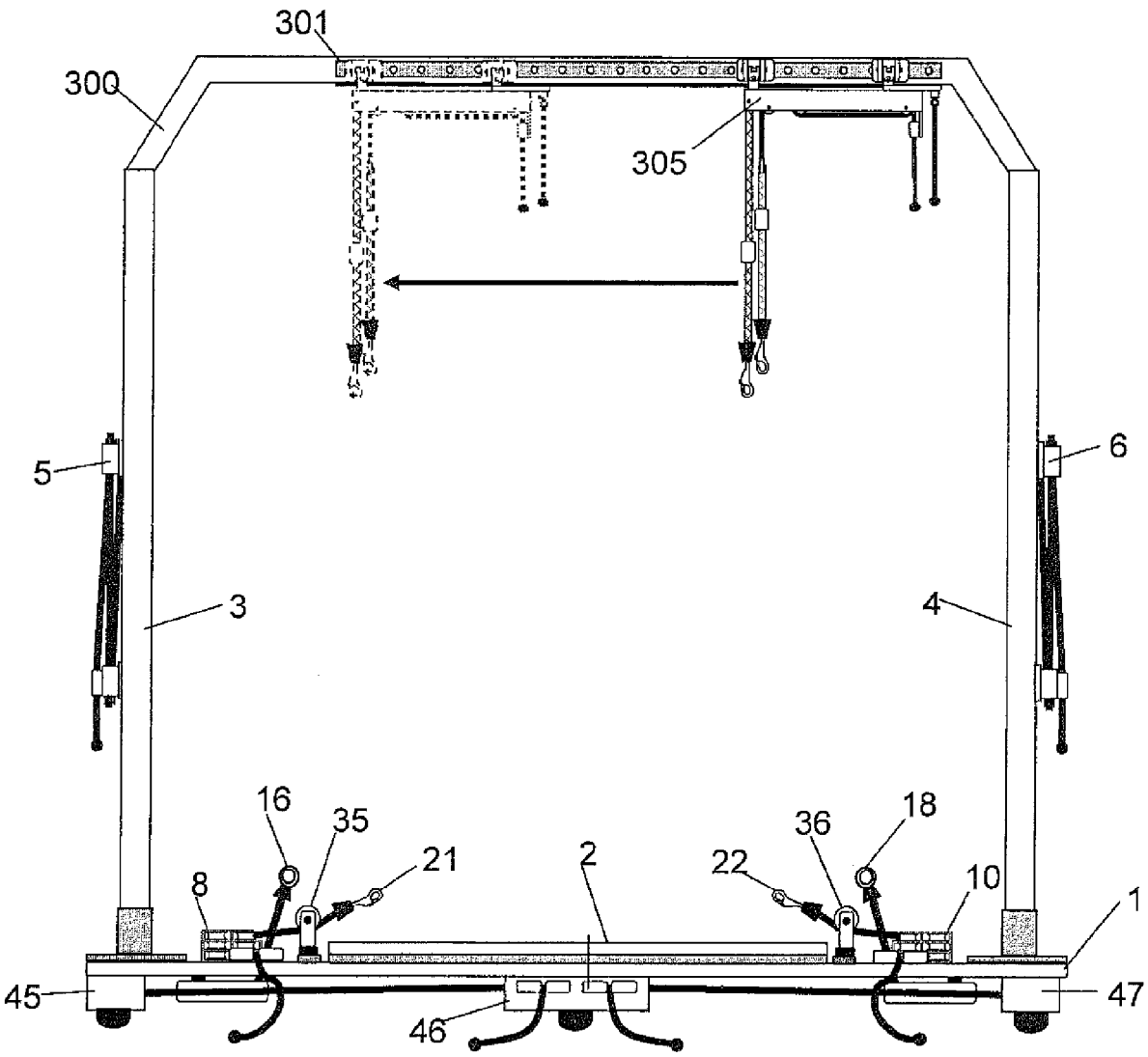
FIG. 28 is a front view the embodiment of FIG. 26 illustrating the sliding range of a trolley assembly of the present disclosure.

FIG. 28 is a front view the embodiment of FIG. 26 illustrating the sliding range of the trolley assembly 305. It should be noted that the range of the safety and hoist members 306, 310 may correspond to the lateral edges of the exercise area 2. However, the orientation of the trolley assembly 305 may be changed ninety degrees on a vertical axis to thereby allow for a greater range of travel on the rails 301, 301B, 302.

Figure 29:
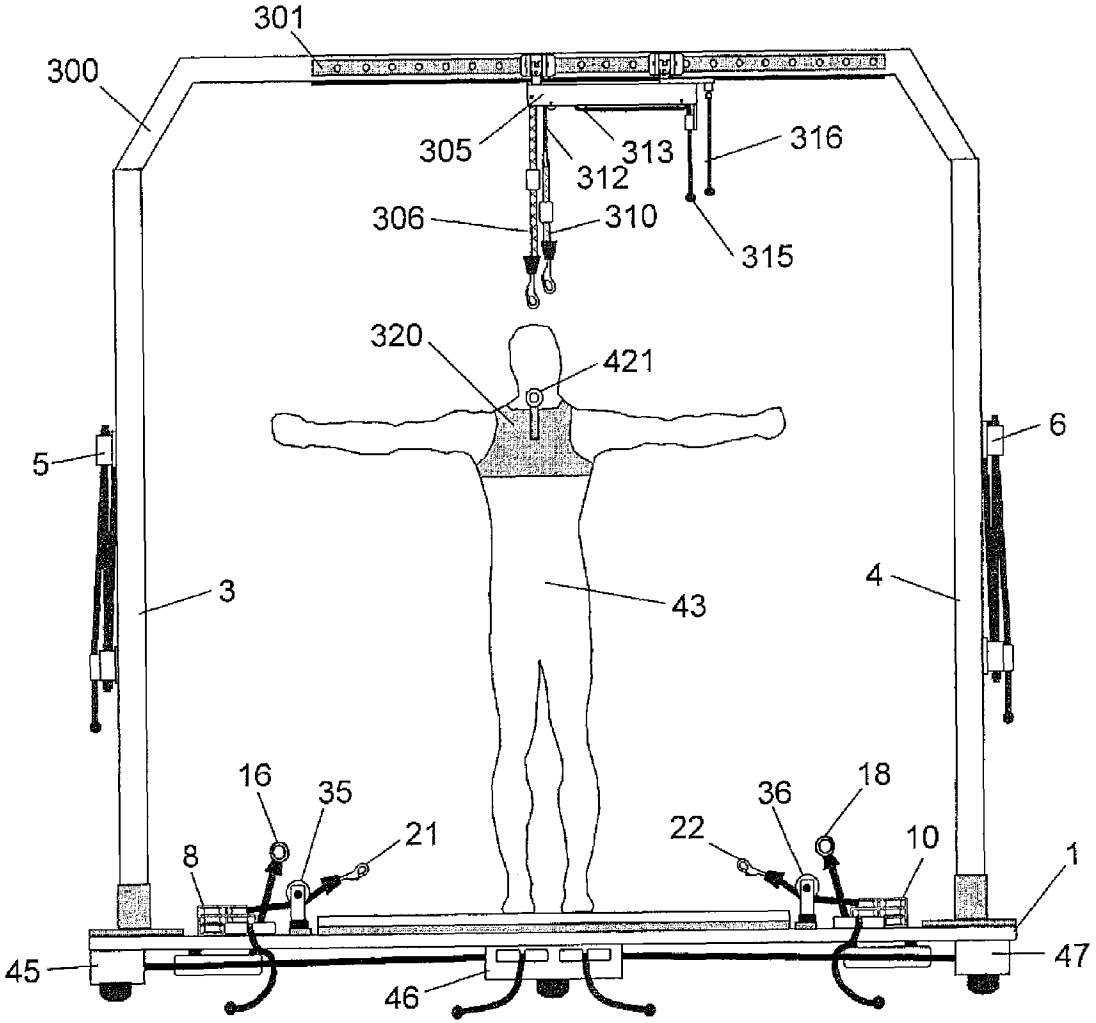
FIG. 29 is a front view of another embodiment of the present disclosure providing training vectors having points of origin variable by direction and elevation to one trainee further providing an overhead support structure.

FIG. 29 is a front view of the embodiment of FIG. 26 illustrating a trainee 43 standing in the exercise area 2. With reference to FIG. 29, the trainee 43 is shown wearing a lift support harness 320 having an attachment means 421 adaptable for attachment to the connector 307, 309 of the safety and hoisting members. The attachment means may comprise any suitable metal ring or rigid structure commonly used in the industry.

Figure 30:
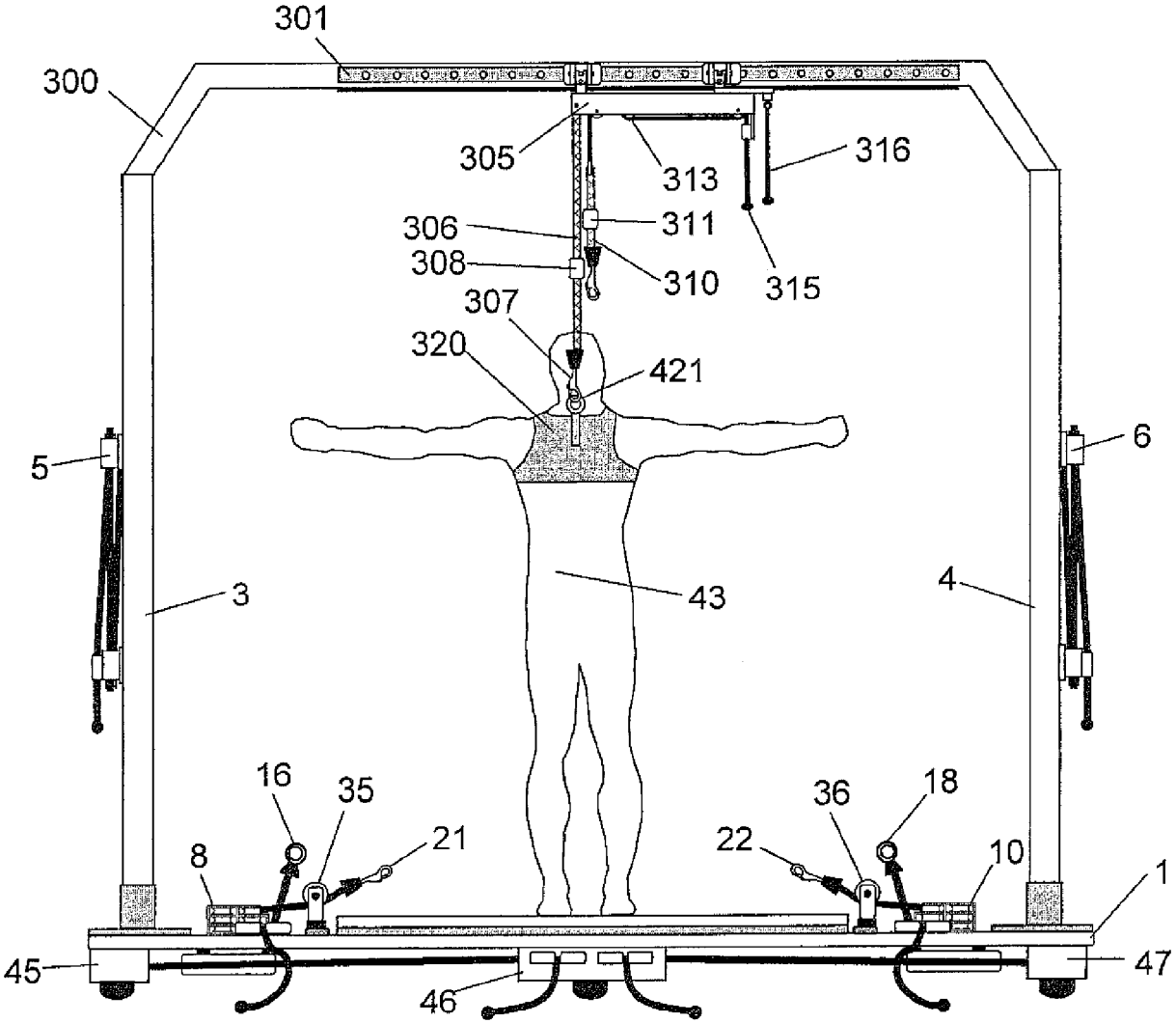
FIGS. 30, 31, 32, and 33 are pictorial illustrations of the attachment, lifting and movement of the trainee to the overhead support structure of the present disclosure.
Figure 31:
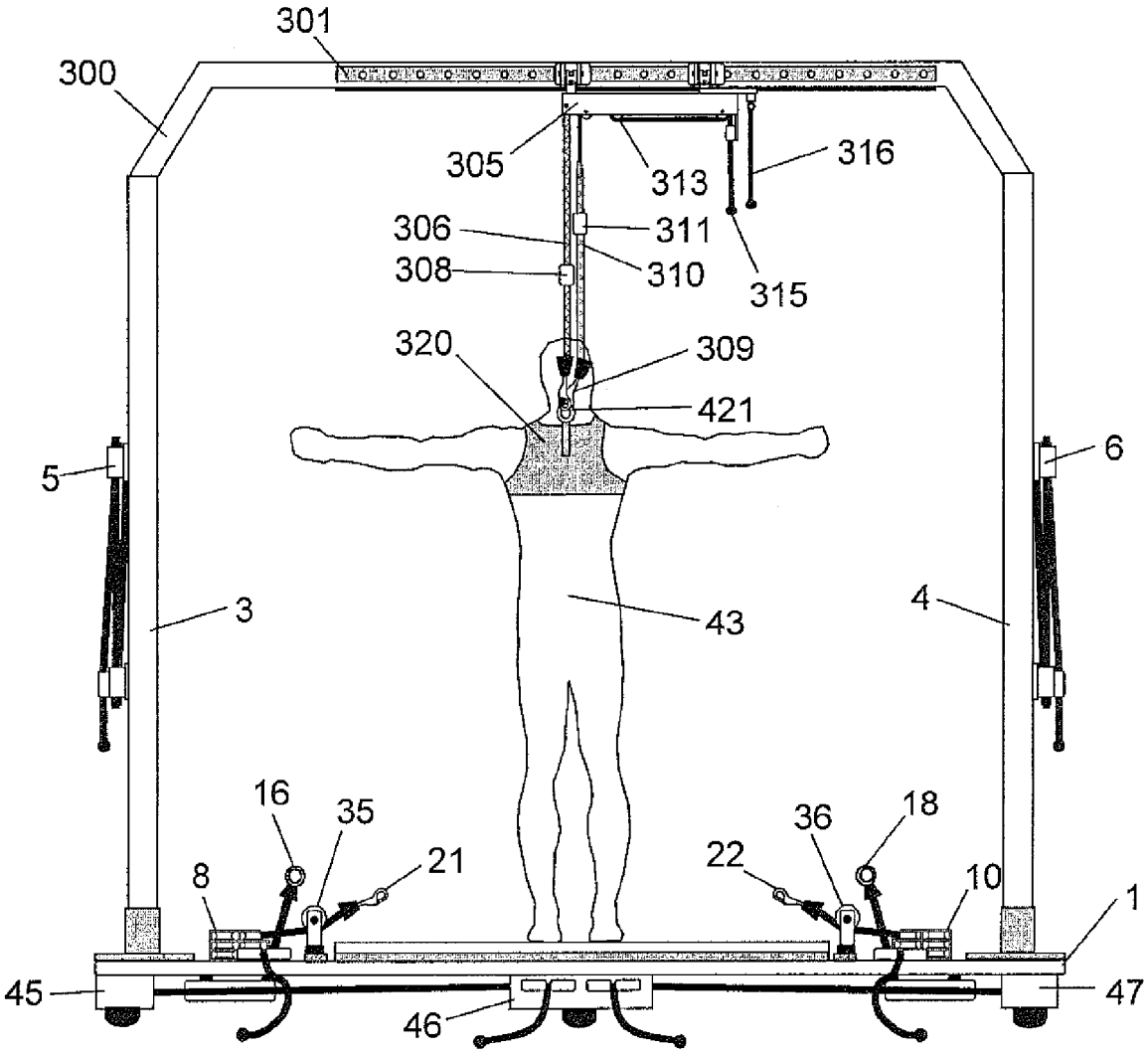

FIGS. 30-33 are pictorial illustrations of the attachment, lifting and movement of the trainee 43 with respect to the overhead support structure 300 of the present disclosure. It should be noted that before any of the safety or hoisting members 306, 310 are attached to the trainee 43, a therapist should lock the trolley assembly 305 in place. With reference to FIG. 30, the safety member 306 is lengthened via the adjustment buckle 308 so that the connector 307 may be connected to the harness attachment means 421. The safety member 306 is then shortened via the buckle 308 until the safety member 306 is taut, thus supporting the trainee 43. With reference to FIG. 31, the hoisting member 310 is then lengthened via the adjustment buckle 311 to allow the connector 309 to connect to the harness attachment means 421. Upon positive connection thereof, the hoisting member 310 is pulled taut via the buckle 311 and a therapist may pull the hoisting cable 315 thus retracting the retracting cable 312 and raising the hoisting member 310.

Figure 32:
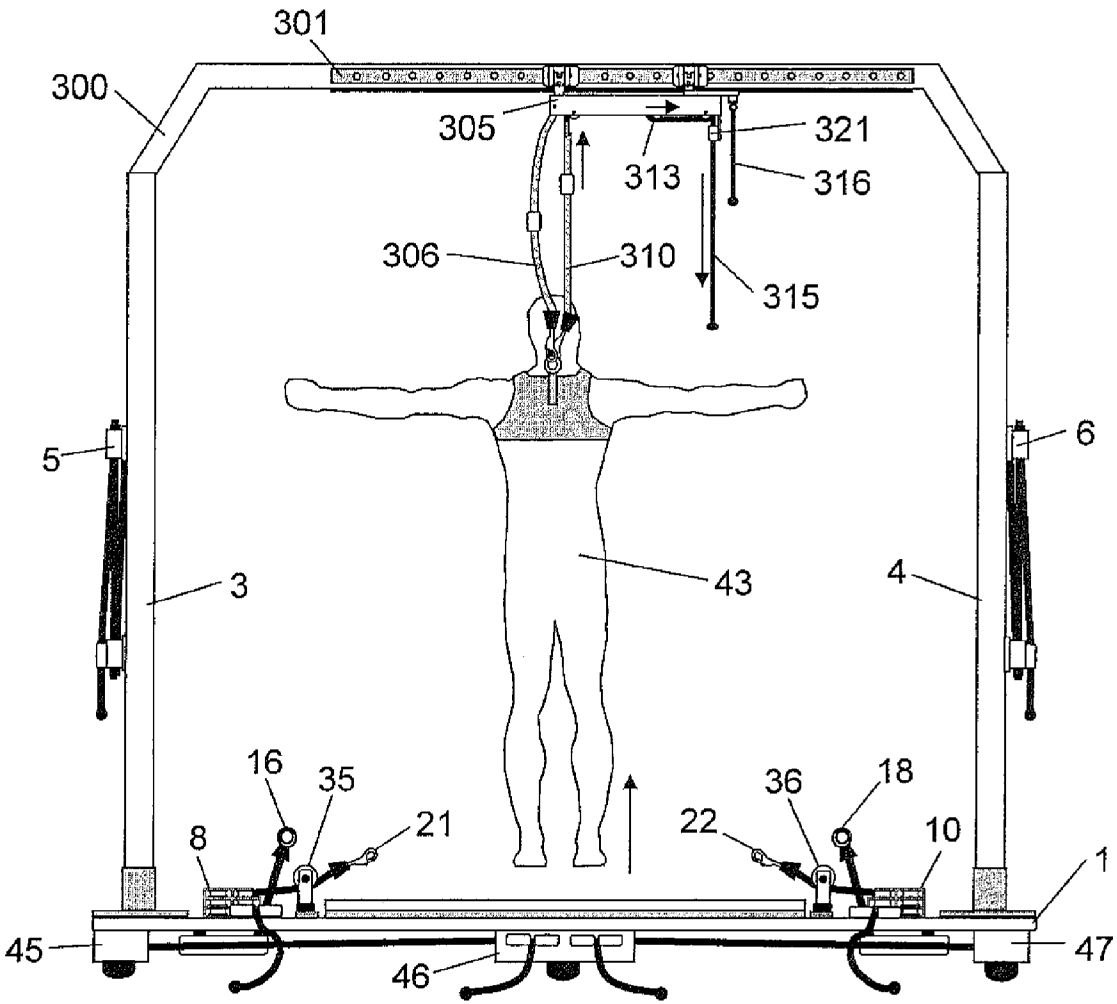
Figure 33:
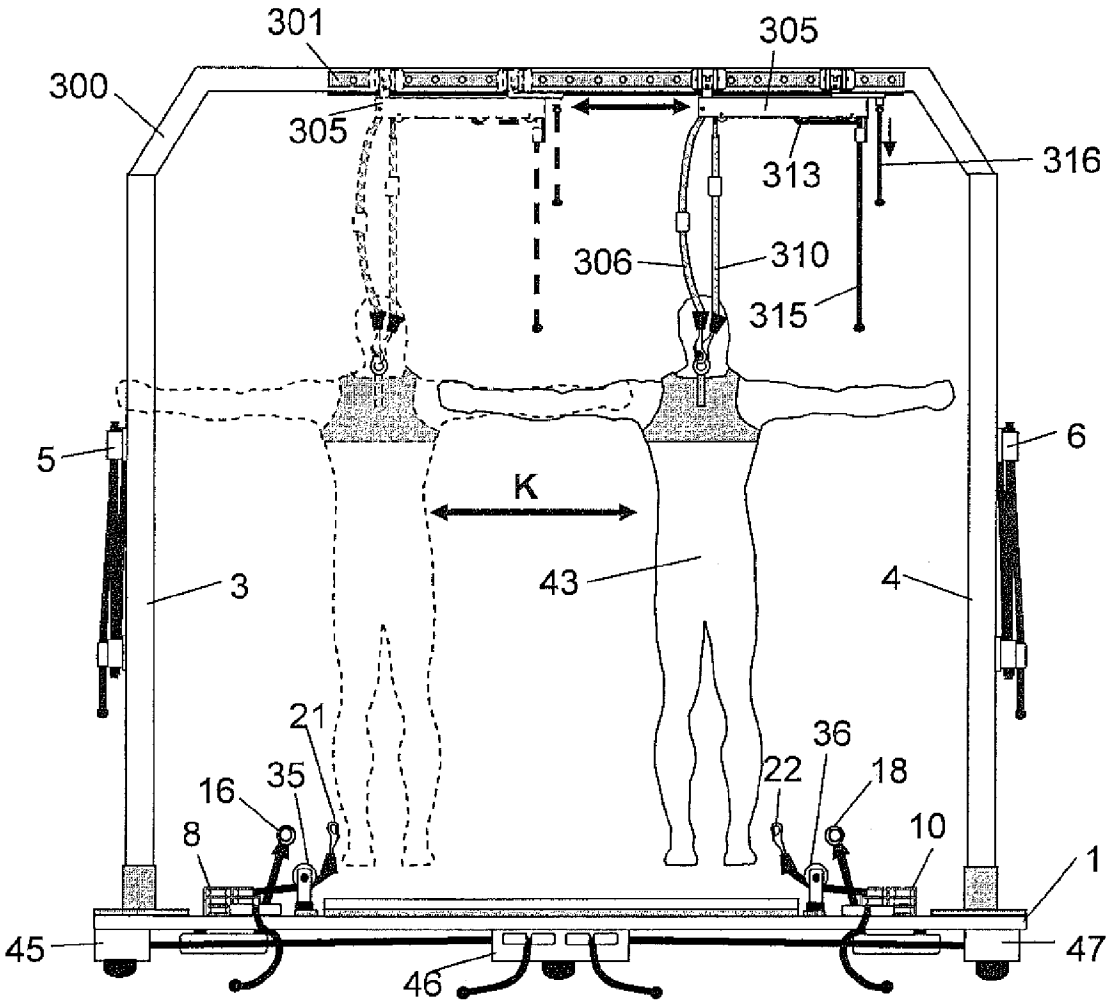

With reference to FIG. 32, once the hoisting member 310 has been attached to the trainee 43 and is taut, the hoisting cable 315 may further be pulled downward thus drawing the sliding pulley assembly 313 to the right and retracting the retracting cable 312 to thereby raise the hoisting member 310 and the trainee 43 connected thereto. The therapist (not shown) may utilize a locking mechanism 321 to secure the hoisting cable 315 once the trainee is lifted to a desired level. As illustrated in FIG. 32, the safety member 306 is slack since the member does not retract into the trolley assembly 305. The therapist, however, has the option of tightening the safety member 306 via the buckle 308. With reference to FIG. 33, a trainee 43, may be moved longitudinally along the rails 301, 301B, 302 in the direction illustrated by the arrow K.

Figure 34:
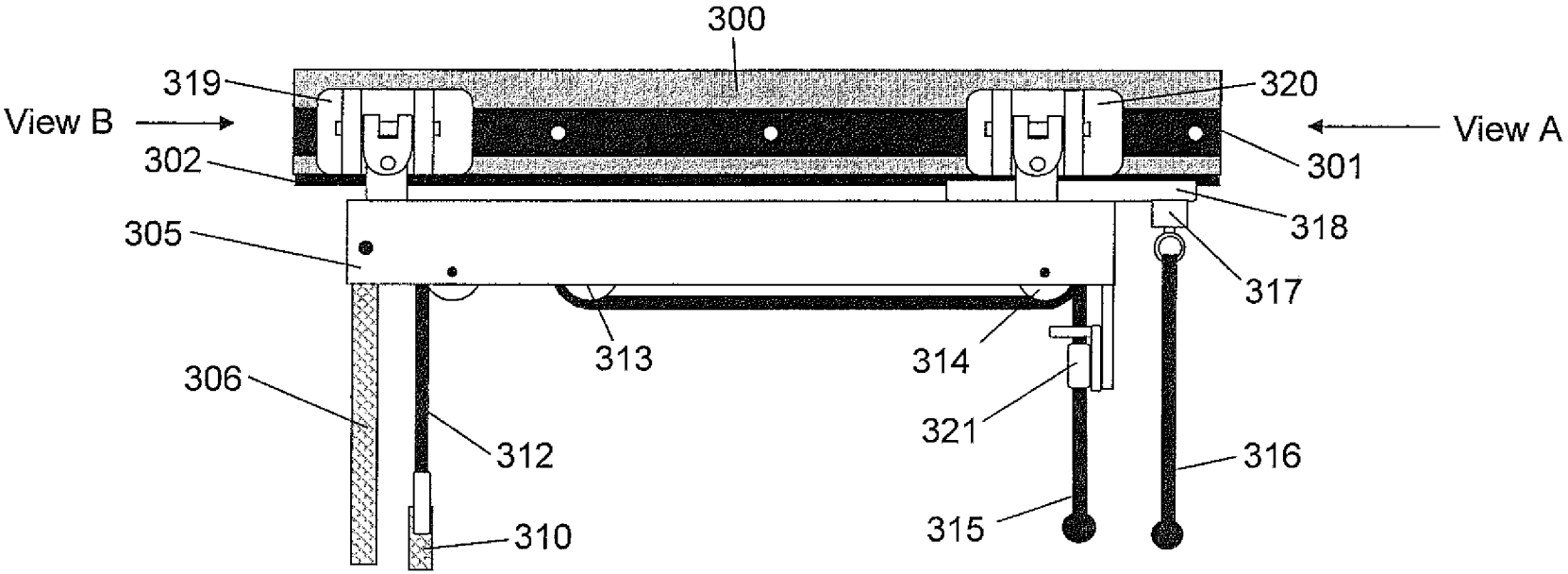
FIG. 34 is a front view of a trolley assembly of the present disclosure.

FIGS. 34-42 illustrate a trolley assembly of the present disclosure. With reference to FIG. 34, the trolley assembly 305 is slideably mounted to the overhead support structure 300 by a plurality of sliding guides 319, 320 and 319B, 320B (not shown). The sliding guides 319, 319B, 320, 320B slide on rails 301, 301B, 302 affixed to the overhead support structure 300. The rails 301, 301B, 302 are slotted so that the trolley assembly 305 may be positioned along the length of the rails 301, 301B, 302. The trolley assembly 305 may also be adaptable to lock in place on the rails 301, 301B, 302 by any suitable locking means such as spring loaded locking mechanisms. One suitable locking means is a locking member 316 operably attached to a locking pin 317. When the locking member 316 is pulled, the trolley assembly 305 is allowed to freely slide along the rails 301, 302. When the locking member 316 is released, the locking pin 317 engages at least one rail and locks the trolley assembly 305 in place. The trolley assembly 305 comprises a fixed pulley assembly 325 which routes a retraction cable 312 from a gliding assembly 323 to a hoisting member 310 having a connector 309 attached thereto for attachment to a harness (not shown) worn by a trainee or patient. A hoisting cable 315 is affixed at one end to the gliding assembly 323 via pulley assemblies 313, 314. An automatic locking means 321 may be utilized to secure movement of the hoisting cable 315 once the trainee 43 has been hoisted to a desired elevation. The locking means 321 may be any suitable type of cam assembly or locking mechanism that securely compresses or grips a member routed therethrough.

Figure 35:
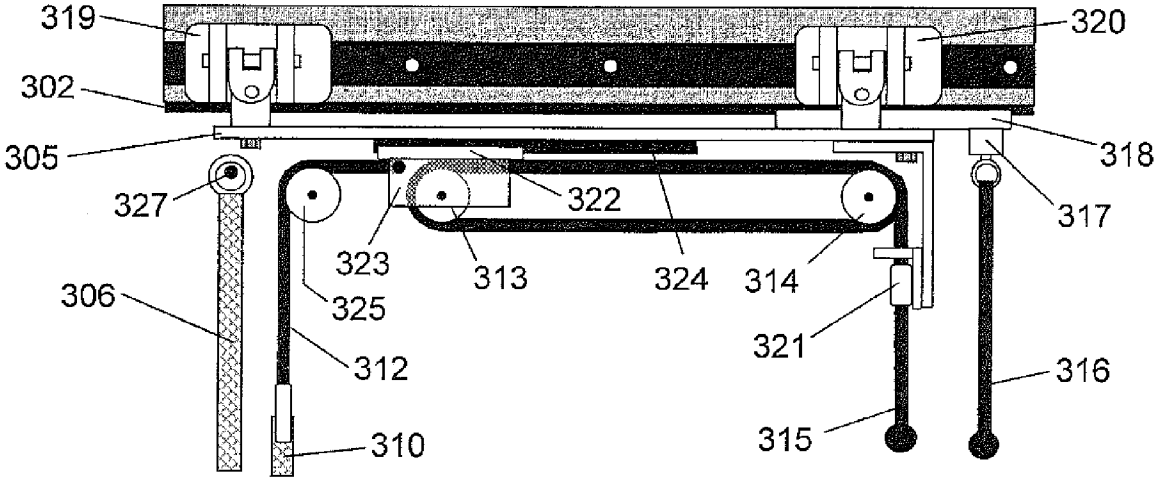
FIGS. 35 and 36 are internal views of the trolley assembly of FIG. 34.
Figure 36:
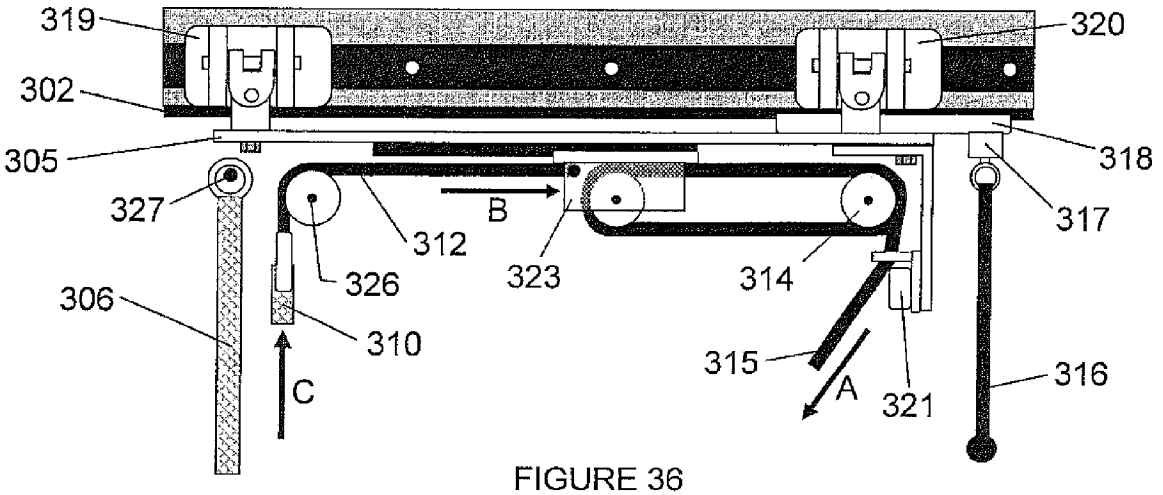

With reference to FIGS. 35 and 36, the outer support cover of the trolley assembly 305 has been removed for illustrative purposes. The safety member 306 is affixed to the trolley assembly 305 via an axle 327. The retractable cable 312 is routed from the hoisting member 310 to the gliding assembly 323 via the fixed pulley assembly 325. The hoisting cable 315 is routed from a distal end thereof to the gliding assembly 323 via the fixed pulley assembly 314 and the slidable pulley assembly 313. The sliding pulley assembly 313 is rotatably mounted to the undercarriage of a gliding assembly 323. The gliding assembly 323 is slidably mounted on a rail 324. The rail 324 is slotted so that the gliding assembly 323 may be linearly positioned along the length of the rail 324 and may be secured in place by a suitable locking mechanism. As illustrated in FIG. 36, a therapist (not shown) may lift a trainee attached to the hoisting member 310 by first disengaging the hoisting cable 315 from the locking mechanism 321 and then pulling the hoisting member 315 in a downward direction illustrated by the arrow A. As the hoisting cable 315 is extracted from the trolley assembly 305, the gliding assembly 323 will move in the direction illustrated by the arrow B, thus approaching the fixed pulley assembly 314. Since the retracting cable 312 is affixed at one end to the gliding assembly 323, the retracting cable will retract the hoisting member 310 in the direction illustrated by the arrow C.

FIG. 37 illustrates a side view of the trolley assembly 305 of FIG. 34 from the aspect identified as view B, and FIG. 38 illustrates a side view of the trolley assembly 305 of FIG. 34 from the aspect identified as view A. With reference to FIGS. 37 and 38, the rails 301, 301B, 302 affixed to the overhead support structure 300 and the sliding glides 319, 319B, 320, 320B which slidably mount the trolley assembly 305 to the overhead support structure 300 are now illustrated.

Figure 39:
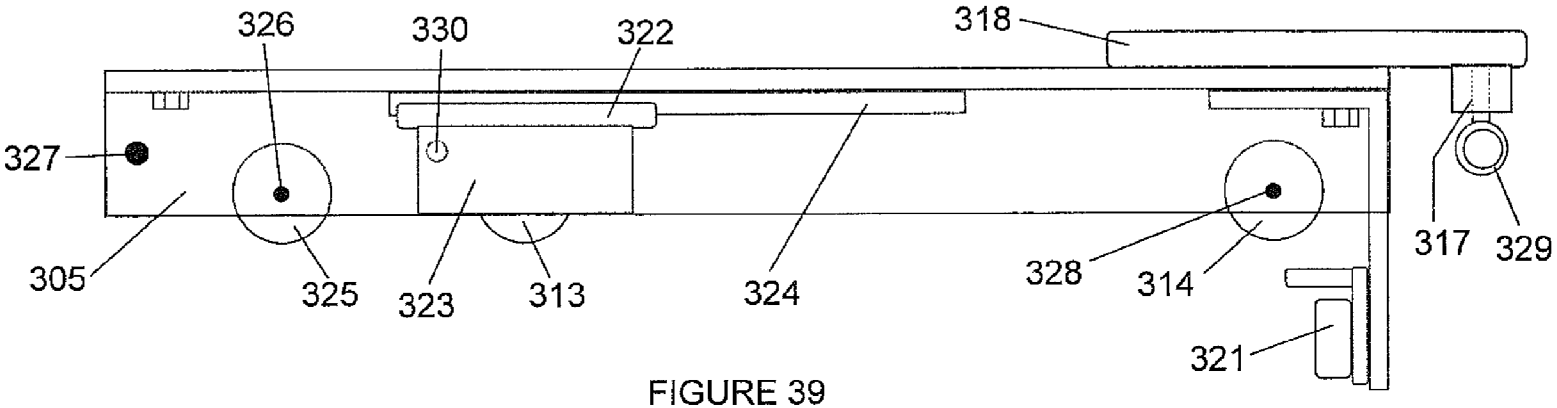
FIG. 39 is another side view of the trolley assembly of FIG. 34.

FIG. 39 is a side view of the trolley assembly 305 having a transparent cover plate for illustrative purposes. With reference to FIG. 39, the axle supports 326-328 for the pulley assemblies 314, 325 and safety member 306 are illustrated. The retracting cable 312 (not shown) may be affixed at one end to the gliding assembly 323 by a rod 330 or other suitable attachment means.

Figure 40:
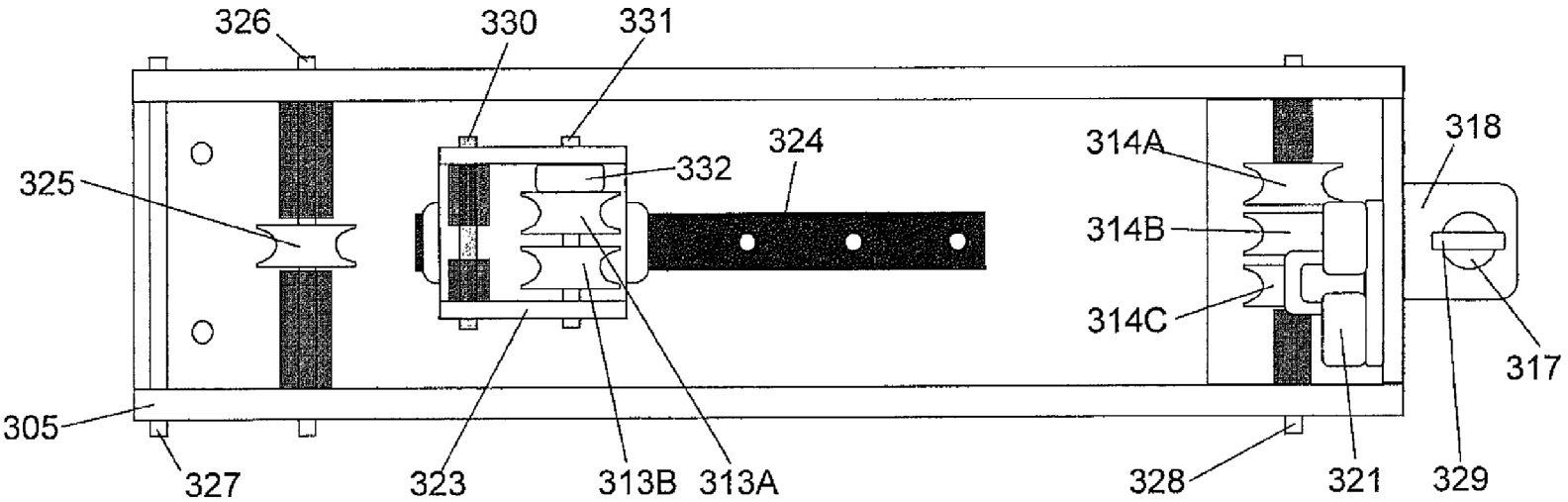
FIGS. 40-42 are a bottom plan views of the trolley assembly of FIG. 34.
Figure 41:
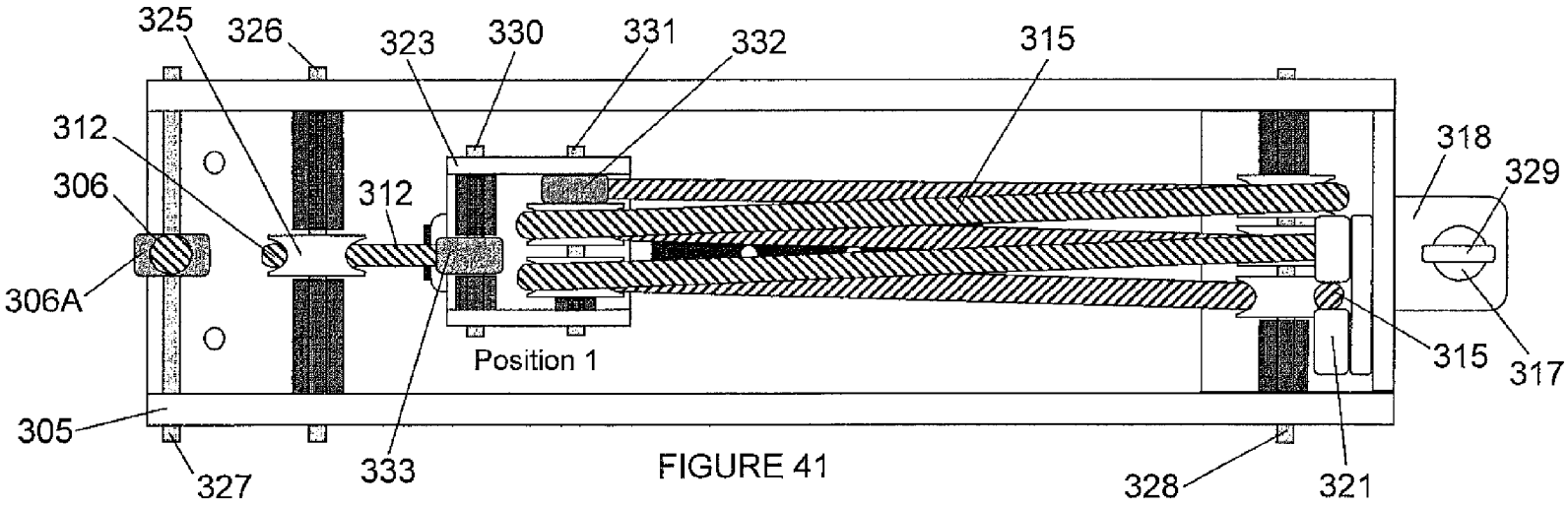
Figure 42:
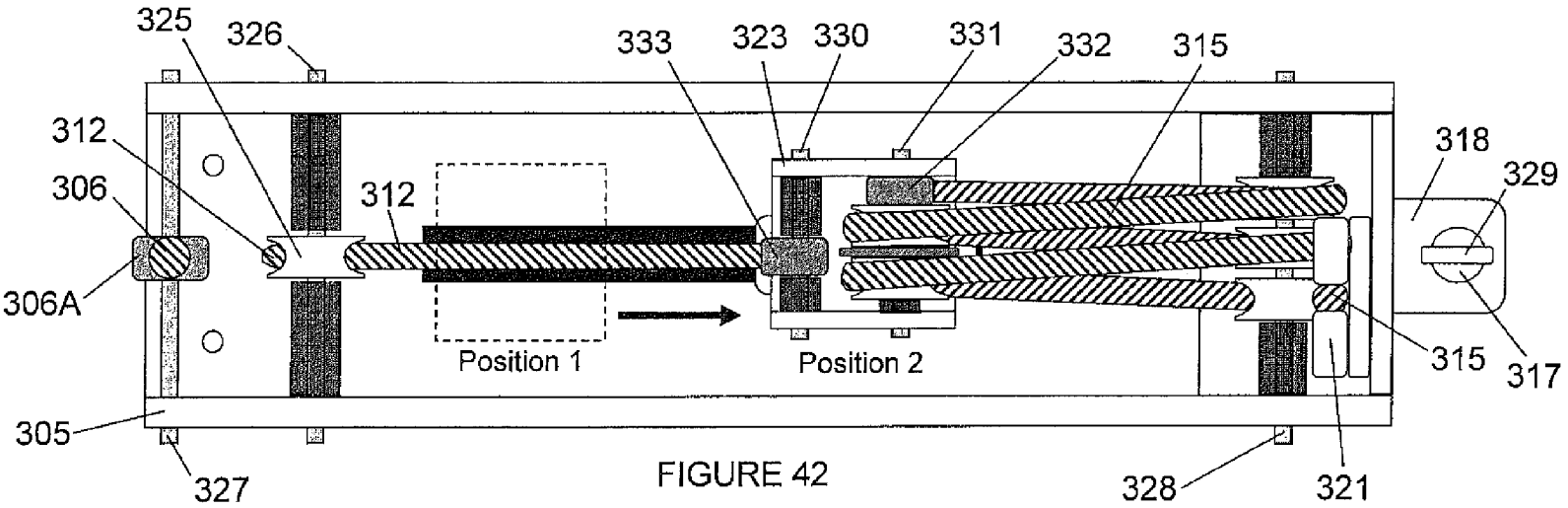

FIGS. 40-42 are bottom plan views of the undercarriage of the trolley assembly 305 of the present invention. With reference to FIGS. 40-42, the slidable pulley assembly is comprised of pulleys 313A, 313B rotatably mounted to the gliding assembly 323 via an axle 331. The gliding assembly 323 further comprises an attachment means 332 for one end of the hoisting cable 315. The fixed pulley assembly 314 may be comprised of pulleys 314A, 314B, 314C rotatably mounted on the trolley assembly 305 via the axle 328. A further view of the locking mechanism 321 for locking the hoisting cable 315 is also illustrated.

With reference to FIGS. 41 and 42, the hoisting cable 315, retracting cable 312 and safety member 306 have been added for illustrative purposes. FIG. 41 illustrates the gliding assembly 323 in a first position with the hoisting cable 315 retracted. FIG. 42 illustrates the gliding assembly 323 in a second position with the hoisting cable 315 extracted. The positions of the gliding assembly 323 shown in FIGS. 41 and 42 are illustrative only and are not intended to limit the scope of the invention. For example, a fully retracted hoisting cable 315 will result in positioning the gliding assembly 323 closer to the fixed pulley assembly 325. Conversely, a fully extracted hoisting cable 315 will result in positioning the gliding assembly 323 closer to the fixed pulley assembly 314. Since the retracting cable 312 is affixed to the gliding assembly 323 via an attachment means 333, operation of the hoisting cable 315, thereby resulting in movement of the gliding assembly 323, will lift a trainee (not shown) attached to the distal end of the hoisting member 310 (not shown). It should be noted that the tracking mechanisms in the trolley assembly 305 may comprise several known pulley configurations capable of providing an increased mechanical advantage to thereby assist a therapist in lifting a heavy load. FIGS. 40-42 illustrate a pulley configuration that provides a 5:1 mechanical advantage. However, there are many obvious configurations that could provide higher or lower mechanical advantages.

As shown by the various configurations and embodiments of the physical training apparatus illustrated in FIGS. 1-42, the physical training apparatus may be used for training athletes and physical therapy patients by providing training vectors to multiple muscle groups of the trainee from various angles and multiple elevations while providing varying or constant magnitudes.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A physical training apparatus comprising:

one or more modules for providing at least six training vectors simultaneously to a trainee, at least one of said modules comprising an elastic member securable at one end to an anchor and extending through a plurality of tracking members to a free end adapted to be connected to a selected portion of a trainee, wherein a length of the elastic member from said anchor to said free end is sufficient to provide a training vector with a relatively constant force opposing movement of the selected portion of the trainee through a predetermined range of motion;

wherein an elevation of an origin of one or more of said training vectors is variable during the movement of the selected portion of the trainee through the predetermined range of motion, and wherein said training vectors originate from at least four elevations.

2. A physical training apparatus comprising:

a first pair of elastic members, each member being secured at one end and extending through a corresponding tracking mechanism to an elevation proximate the elevation of the hips of the trainee, each member extending to a free end adapted to be secured to a hip of a trainee, the length of said members from the secured end to the free end thereof being sufficient to provide a training vector with a force opposing the rotation of the hips of a trainee performing a golf swing; and a second pair of elastic members, each member being secured at one end and extending through a corresponding tracking mechanism to an elevation above the hips of the trainee, each member extending to a free end adapted to be secured to a shoulder of a trainee, the length of said members from the secured end to the free end thereof being sufficient to provide a training vector with a force opposing the rotation of the shoulders of a trainee performing a golf swing.

3. The physical training apparatus of claim 2 wherein each member in the second pair extends through a corresponding tracking mechanism to an elevation above the shoulders of the trainee.

* * * * *